US009526960B2

(12) United States Patent
Leinert

(10) Patent No.: US 9,526,960 B2
(45) **Date of Patent: *Dec. 27, 2016**

(54) BASEBALL BAT

(71) Applicant: Bruce R. Leinert, Dover Plains, NY (US)

(72) Inventor: Bruce R. Leinert, Dover Plains, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/456,717

(22) Filed: Aug. 11, 2014

(65) Prior Publication Data

US 2014/0349790 A1 Nov. 27, 2014

Related U.S. Application Data

(63) Continuation of application No. 13/692,706, filed on Dec. 3, 2012, now Pat. No. 8,801,551, which is a continuation of application No. 13/305,413, filed on Nov. 28, 2011, now Pat. No. 8,323,131, which is a continuation of application No. 12/987,798, filed on Jan. 10, 2011, now Pat. No. 8,066,594, which is a continuation of application No. 11/940,963, filed on Nov. 15, 2007, now Pat. No. 7,878,930.

(51) Int. Cl.

| | |
|---|---|
| ***A63B 59/06*** | (2006.01) |
| ***A63B 59/00*** | (2015.01) |
| *A63B 49/08* | (2015.01) |

(52) U.S. Cl.

CPC ..... *A63B 59/0014* (2013.01); *A63B 59/50* (2015.10); *A63B 60/06* (2015.10); *A63B 60/08* (2015.10); *A63B 60/10* (2015.10); *A63B 60/12* (2015.10); *A63B 60/14* (2015.10); *A63B 49/08* (2013.01); *A63B 59/51* (2015.10); *A63B 59/52* (2015.10); *A63B 59/54* (2015.10); *A63B 2102/18* (2015.10)

(58) Field of Classification Search

CPC ..... A63B 59/06; A63B 2102/18; A63B 2102/182; A63B 59/50–59/56; A63B 53/14; A63B 2069/0008

USPC ..... 473/457, 519, 520, 564–568, 300; 30/308.1; 81/489

See application file for complete search history.

(56) References Cited

U.S. PATENT DOCUMENTS

| | | | |
|---|---|---|---|
| 400,354 | A | 3/1889 | Morris |
| 430,388 | A | 6/1890 | Kinst |
| 780,244 | A | 1/1905 | Truesdell |
| 2,084,591 | A | 6/1937 | Pardoe |
| 2,169,774 | A | 8/1939 | Taylor |
| 2,379,006 | A | 6/1945 | Johnson |
| 2,394,184 | A | 2/1946 | Janis |
| 2,690,338 | A | 6/1951 | De Brocke |
| 2,659,605 | A | 11/1953 | Le Tourneau |

(Continued)

FOREIGN PATENT DOCUMENTS

| | | |
|---|---|---|
| GB | 0 362 604 | 12/1931 |
| WO | WO-2007/019566 | 2/2007 |

OTHER PUBLICATIONS

Nathan, Alan M. et al., "The Physics of the Trampoline Effect in Baseball and Softball Bats," (7 pages, Date Unknown).

(Continued)

*Primary Examiner* — Mark Graham

(74) *Attorney, Agent, or Firm* — Foley & Lardner LLP; Christopher J. McKenna; Shabbi S. Khan

(57) ABSTRACT

Baseball bats described herein may have handle, throat and/or barrel portions that include non-circular cross-sections.

28 Claims, 26 Drawing Sheets

(56) References Cited

U.S. PATENT DOCUMENTS

| | | | | |
|---|---|---|---|---|
| D178,866 | S | 10/1956 | Cole, Sr. | |
| 2,793,859 | A | 5/1957 | Darling et al. | |
| 2,798,292 | A | 7/1957 | Bishaf | |
| 2,944,820 | A | 7/1960 | Paullus | |
| 2,984,486 | A | 5/1961 | Jones | |
| 3,104,876 | A | 9/1963 | Salsinger | |
| D197,180 | S | 12/1963 | Salisbury | |
| 3,129,003 | A | 4/1964 | Mueller et al. | |
| 3,252,489 | A * | 5/1966 | Huston | B25G 1/08 16/111.1 |
| 3,554,545 | A | 1/1971 | Mann et al. | |
| 3,697,069 | A | 10/1972 | Merola | |
| 3,921,978 | A | 11/1975 | Warren | |
| 4,038,719 | A | 8/1977 | Bennett | |
| 4,098,503 | A | 7/1978 | Antone | |
| 4,147,348 | A | 4/1979 | Lee | |
| 4,183,100 | A | 1/1980 | De Marco | |
| 4,183,528 | A | 1/1980 | An | |
| D263,863 | S | 4/1982 | Golab | |
| 4,331,330 | A | 5/1982 | Worst | |
| 4,344,901 | A | 8/1982 | Keathley | |
| 4,360,201 | A | 11/1982 | Biehl et al. | |
| D267,469 | S | 1/1983 | Crowder | |
| 4,418,732 | A | 12/1983 | Kolonia | |
| D273,759 | S | 5/1984 | Drori | |
| 4,445,687 | A | 5/1984 | Merritt | |
| D275,261 | S | 8/1984 | Crowder | |
| 4,561,122 | A | 12/1985 | Stanley et al. | |
| 4,565,367 | A | 1/1986 | Kaiser | |
| D282,523 | S | 2/1986 | Riemann | |
| 4,572,508 | A | 2/1986 | You | |
| 4,653,754 | A | 3/1987 | Cross | |
| 4,659,080 | A | 4/1987 | Stoller | |
| 4,674,746 | A | 6/1987 | Benoit | |
| 4,759,546 | A | 7/1988 | Steele, Jr. | |
| 5,088,733 | A | 2/1992 | Barnea et al. | |
| D324,473 | S | 3/1992 | Chen | |
| 5,095,623 | A | 3/1992 | Williams | |
| 5,114,144 | A | 5/1992 | Baum | |
| 5,125,130 | A | 6/1992 | Stanish | |
| 5,170,664 | A | 12/1992 | Hirsh et al. | |
| 5,180,163 | A | 1/1993 | Lanctot | |
| 5,269,511 | A | 12/1993 | Chavez | |
| 5,284,332 | A | 2/1994 | DiTullio | |
| D351,868 | S | 10/1994 | Pendergast | |
| D355,011 | S | 1/1995 | Subnick | |
| 5,460,369 | A | 10/1995 | Baum | |
| 5,482,072 | A | 1/1996 | Cimino | |
| 5,482,270 | A | 1/1996 | Smith | |
| 5,511,445 | A | 4/1996 | Hildebrandt | |
| 5,551,690 | A | 9/1996 | Brown | |
| 5,588,921 | A | 12/1996 | Parsick | |
| 5,692,265 | A | 12/1997 | Dalury | |
| 5,709,031 | A * | 1/1998 | Van Beek | B26B 23/00 30/308.1 |
| 5,782,705 | A * | 7/1998 | Solari | A63B 53/007 473/300 |
| 5,792,002 | A | 8/1998 | Bothwell | |
| 5,839,983 | A | 11/1998 | Kramer | |
| 5,979,015 | A | 11/1999 | Tamaribuchi | |
| D417,895 | S | 12/1999 | Kim et al. | |
| 6,004,234 | A | 12/1999 | Majchrowicz | |
| D422,869 | S | 4/2000 | Chen | |
| D424,903 | S | 5/2000 | Hreha | |
| D426,451 | S | 6/2000 | Rosenbaum | |
| 6,083,125 | A | 7/2000 | West | |
| D431,987 | S | 10/2000 | Staton | |
| D431,988 | S | 10/2000 | Staton | |
| D432,381 | S | 10/2000 | Khachatoorian | |
| 6,235,134 | B1 | 5/2001 | Mueller | |
| D444,193 | S | 6/2001 | Dodson | |
| D444,689 | S | 7/2001 | Staton | |
| D444,834 | S | 7/2001 | Tucker, Sr. | |
| 6,305,051 | B1 | 10/2001 | Cho | |
| 6,416,327 | B1 | 7/2002 | Wittenbecher | |
| 6,500,079 | B1 | 12/2002 | Tucker, Sr. | |
| 6,625,848 | B1 | 9/2003 | Schneider | |
| 6,654,959 | B1 | 12/2003 | Alpert | |
| 6,723,001 | B2 | 4/2004 | Ferris | |
| 6,739,021 | B2 | 5/2004 | Rabello | |
| 6,743,127 | B2 | 6/2004 | Eggiman et al. | |
| 6,752,731 | B1 | 6/2004 | Kramer | |
| 6,767,299 | B1 | 7/2004 | Chang | |
| 7,086,973 | B2 | 8/2006 | Wells et al. | |
| 7,351,167 | B1 | 4/2008 | Hathaway | |
| 7,404,346 | B2 | 7/2008 | Youngreen et al. | |
| 7,488,266 | B2 | 2/2009 | Tucker, Jr. et al. | |
| 7,744,497 | B2 | 6/2010 | Phelan, Jr. | |
| 7,878,930 | B2 * | 2/2011 | Leinert | A63B 59/06 473/568 |
| 8,066,594 | B2 * | 11/2011 | Leinert | A63B 59/06 473/568 |
| 8,323,131 | B2 * | 12/2012 | Leinert | A63B 59/06 473/568 |
| 8,801,551 | B2 * | 8/2014 | Leinert | A63B 59/06 473/568 |
| 2003/0144089 | A1 | 7/2003 | Ryan | |
| 2004/0147345 | A1 | 7/2004 | Michelet et al. | |
| 2004/0162168 | A1 | 8/2004 | Ginkel | |
| 2004/0248664 | A1 * | 12/2004 | Billings | A63B 53/14 473/300 |
| 2005/0124442 | A1 | 6/2005 | Wells et al. | |
| 2005/0202910 | A1 | 9/2005 | Blount | |
| 2005/0272537 | A1 | 12/2005 | Kramer | |
| 2006/0063620 | A1 | 3/2006 | Page et al. | |
| 2007/0259732 | A1 | 11/2007 | Billings et al. | |

OTHER PUBLICATIONS

Mussil, Bernie, "The Evolution of the Baseball Bat", Oldtyme Baseball News, vol. 4 (2), updated 1999,2000. Copyright 2000 Bernie Mussill, 2000).

Sherwood, James A. et al., "Characterizing the Performance of Baseball Bats Using Experimental and Finite Element Methods," (10 pages, Date Unknown).

Noble, Larry, "Inertial and Vibrational Characteristics of Softball and Baseball Bats: Research and Design Implications," (12 pages, Date Unknown).

Manier, Jeremy, "Science has a Sweet Spot for Baseball," Chicago Tribune (Apr. 3, 2000).

Bahill, A. Terry, "The Ideal Moment of Inertia for a Baseball or Softball Bat" IEEE, Transactions on Systems, Man, and Cybernetics-Part A: Systems and Humans, vol. 34, No. 2, pp. 197-204 (Mar. 2004).

Cross, Rod, Nathan, Alan M.; "Scattering of a Baseball by a Bat", Am. J. Phys. 74 (10), pp. 896-904 (Oct. 2006).

Nathan, Alan M., "Dynamics of the Baseball-Bat Collision," Am. J. Phys. vol. 68, pp. 979-990 (Nov. 2000).

Jaramillo, Paola et al., "Sweet Spot" or "Sweet Zone?", Modal Analysis of a Wooden Baseball Bat for Design Optimization, Proceedings of IMECE, 03, 2003 ASME International Mechanical Engineering Congress (Nov. 15-21, 2003).

Nathan, Alan M., "Characterizing the Performance of Baseball Bats" Am. J. Phys. vol. 71 (2), pp. 134-143, (Feb. 2003).

Williams, Ted & Underwood, John, "The Science of Hitting," (New York: Simon & Schuster, Inc., 1986; 1st ed. 1970).

"Interphalangeal Articulations of Hand", www.wikipedia.org, (Feb. 20, 2006-Mar. 4, 2007).

Revision History of Interphalangeal Articulations of Hand, www.wikipedia.org, (Mar. 4, 2007).

"The Batting Grip", Baseball-Excellence.com (2002).

Baker, Geoff, "Mariners being given new "Axe" bats to try," The Seattle Times, http://seattletimes.nwsource.com/cgi-bin/PrintStory.pl?documentid=- 2011195627&zsection, Feb. 26, 2010.

Baker, Geoff, "Federal Way company trying to cut into the bat business with it's "Axe" bat," The Seattle Times, http://seattletimes.nwsource.com/cgi-bin/PrintStory.pl?documentid=2011212- 331 &zsection, Mar. 1, 2010.

(56) References Cited

OTHER PUBLICATIONS

Baker, Geoff, "Players take swing at no-knob bat", McClatchy-Tribune News, http://www.ottawacitizen.com/story.sub.--print.html?id=2631551&sponsor, Mar. 2, 2010.
"New-Style bat and glove making way onto field", ESPN.com, http://espn.go.com/espn/print?id=4962098&type=blogEntry, Mar. 3, 2010.
Street, Jim, "A Mariners legend returns—as pitchman", Street's Corner, http://jimstreet.mlblogs.com/archives/2010/02/.sub.--jay.sub.--buhner.sub- .--ken.sub.--griffey.html, Feb. 27, 2010.
"Jay Buhner-Bat Man", Mariners Blog, http://www.mynorthwest.com/?nid=374&sid=290078, Feb. 27, 2010.
"Baden Axe Handle Maple Wood Baseball Bat", TeamExpress.com, http://www.teamexpress.com, Mar. 11, 2010.
"Axe Bats Receive Full Approval for Professional Play", Baden, http://badensports.com/new.sub.--detail/2754.htm, Mar. 8, 2010.
Clayton, John, "John Clayton: Freddy's 'invention' up at bat?", Unionleader.com, http://unionleader.com/articie.aspx?headline=John+Clayton%3a+Freddy%27s+%- 27in . . . , Apr. 5, 2010.
Dwyer, J., "Bat Boy," St. Louis Business Journal, Apr. 21, 2006, Accessed from: http://stlouis.bizjournals.com/stlouis/stories/2006/04/24/tidbits1.- html, 1 page.
Non-Final Office Action for U.S. Appl. No. 13/692,706, mailed Aug. 5, 2013.
Notice of Allowance for U.S. Appl. No. 13/692,706, mailed Mar. 28, 2014.
Final Office Action for U.S. Appl. No. 13/692,706, mailed Dec. 26, 2013.

* cited by examiner

BASEBALL BAT

RELATED APPLICATIONS

This is a continuation of U.S. patent application Ser. No. 13/305,413, filed Nov. 28, 2011, which is a continuation of U.S. patent application Ser. No. 12/987,798, filed Jan. 10, 2011, which is a continuation of U.S. patent application Ser. No. 11/940,963, filed Nov. 15, 2007, now U.S. Pat. No. 7,878,930. The contents of the foregoing applications are hereby incorporated herein by reference in their entirety.

BACKGROUND

1. Field of the Technology

The devices and methods described herein relate to baseball bats.

2. Discussion

A baseball bat is an elongated device used, in the sport of baseball, to hit a pitched ball into the playing field. A typical bat has a barrel, a throat, and a handle. The bat's circumference is greatest at a location of the barrel, which is adjacent the top of the bat, and the circumference is smallest at a location of the handle, which is adjacent the bottom of the bat. In the throat, the bat tapers from the dimension of the circumference of a location of the barrel to that of a location of the handle. The circumferential surface of the barrel is typically intended to strike a baseball. The handle includes a portion that is sized to be grasped by a user's hands. At the bottom end, a typical baseball bat terminates in a knob that projects radially outward, such that the knob has a larger circumference than that of other adjacent parts of the handle.

BRIEF SUMMARY

In general, in one aspect, a baseball bat described herein may have a handle portion with a non-circular cross-section.

In another aspect, a baseball bat described herein may have a handle portion with a generally oblong cross-section.

In another aspect, a baseball bat described herein may have a barrel that defines a longitudinal axis and a handle portion with a non-circular cross section that defines an axis with a midpoint that is spaced from the longitudinal axis.

In another aspect, a baseball bat described herein may have a barrel that defines a longitudinal axis and a handle portion that defines a front edge and a rear edge.

In another aspect, a baseball bat described herein may have a handle portion with an asymmetrical cross-section.

BRIEF DESCRIPTION OF THE FIGURES

Certain illustrative embodiments are described below with reference to the accompanying figures in which.

DETAILED DESCRIPTION

Figure 1:
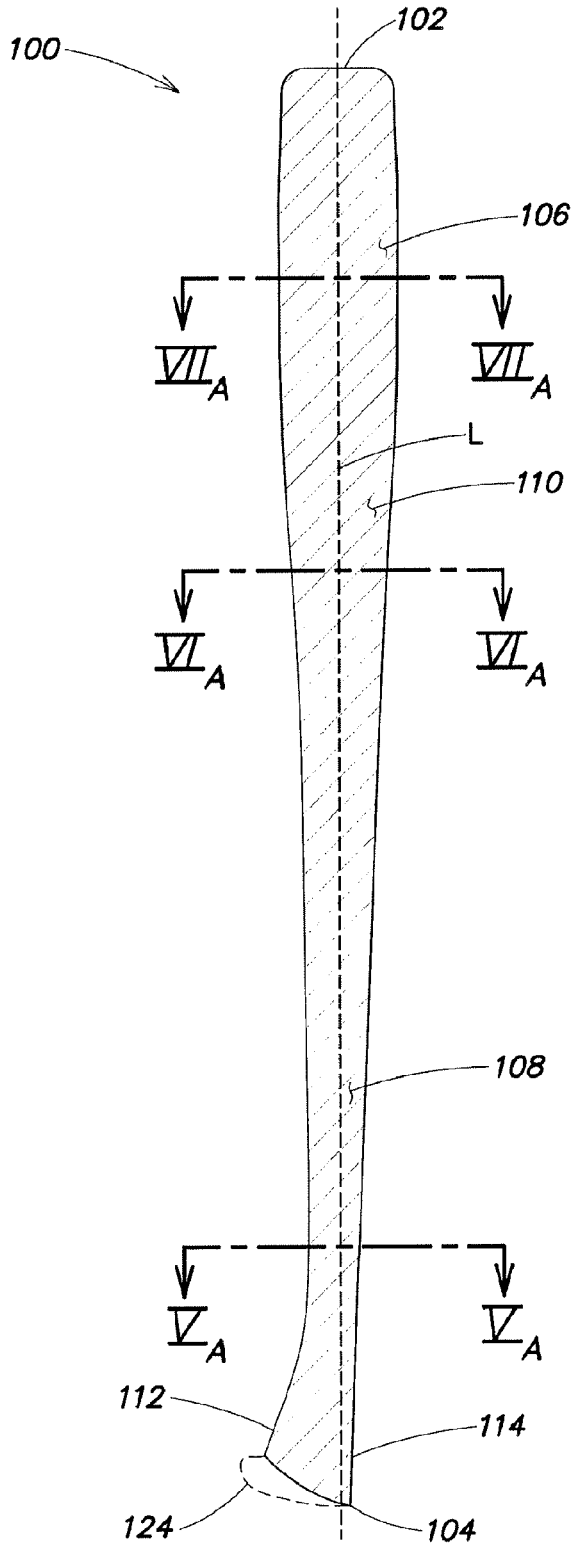
FIG. 1 is a vertical section of an exemplary embodiment of a baseball bat.

Embodiments of the baseball bats described herein may be grasped and swung more comfortably than traditional baseball bats. Embodiments described herein may also assist the batter in maintaining a particular orientation of the bat relative to the batter's hands, when the bat is grasped for swinging. Embodiments described herein may also allow a batter to have a more secure grip on the bat, by comparison with traditional baseball bats. Embodiments described herein may comprise any desired material—including wood (e.g., ash, maple, or hickory), metals (e.g., aluminum, steel, titanium and or alloys of any such metals), plastics, composite materials, and cured or resin-filled fibers (e.g., fiberglass, Nylon, carbon fiber, or aramid fibers such as KEVLAR fibers). Embodiments of baseball bats described herein may comprise handle sections formed separately from other portions of the respective bats. If applied to bats milled from lumber, embodiments described herein may help a batter maintain the bat in a desired orientation during the batter's swing—e.g., such that the wood grain may be oriented generally edgewise to a struck ball, so that the force of the swung bat can be transferred to the ball in a direction generally parallel to the wood grain. Embodiments described herein may resist flexing or twisting to a greater extent than traditional baseball bats having comparable length, mass, volume, center of mass, and/or distribution of mass along the length of the bat. Embodiments described herein may also create less air-resistance, during a swing, by comparison with traditional baseball bats. Additional features and advantages are disclosed in the following description and in the accompanying drawings.

FIGS. 1, 3A-3F, and 4A-4G show baseball bats 100, 300 and 400, each having a respective top end 102, 302 and 402

(at one lengthwise extremity thereof, measured along the respective longitudinal axis, described herein) bottom end 104, 304 and 404 (at the other lengthwise extremity thereof, measured along the respective longitudinal axis), barrel 106, 306 and 406, adjacent the respective top end, handle 108, 308 and 408 adjacent the respective bottom end, and throat 110, 310 and 410 adjacent both the respective handle and the respective barrel.

Figure 3A:
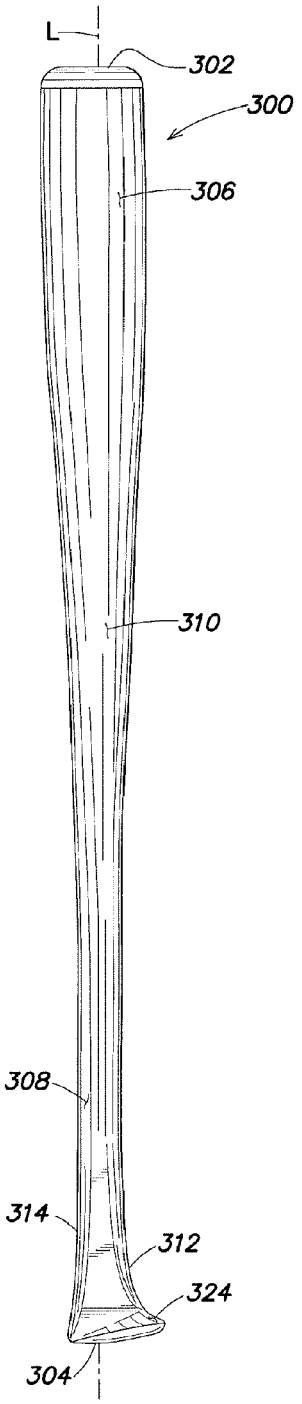
FIGS. 3A-3F show perspective views of an exemplary embodiment of a baseball bat.
Figure 3B:
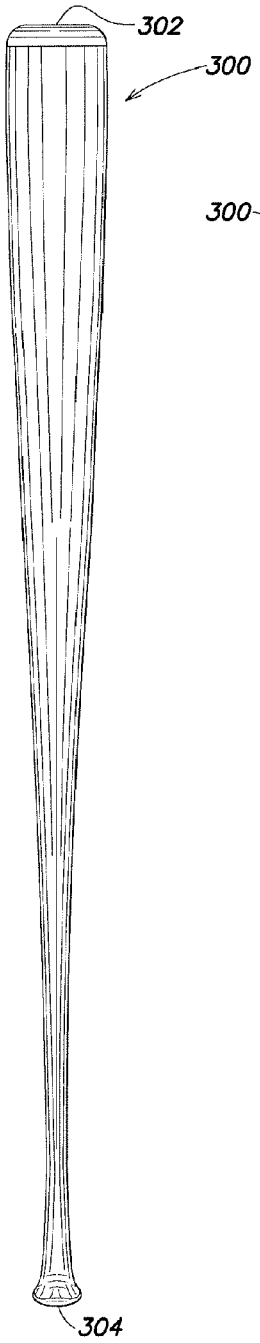
Figure 3C:
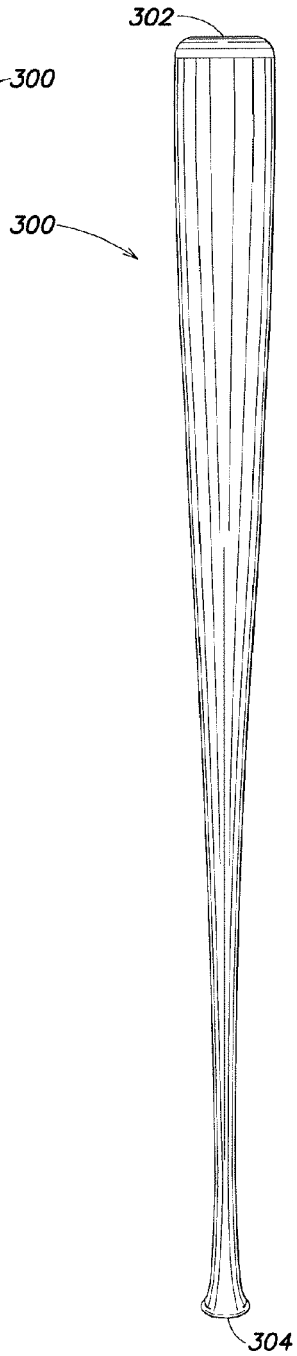
Figure 3D:
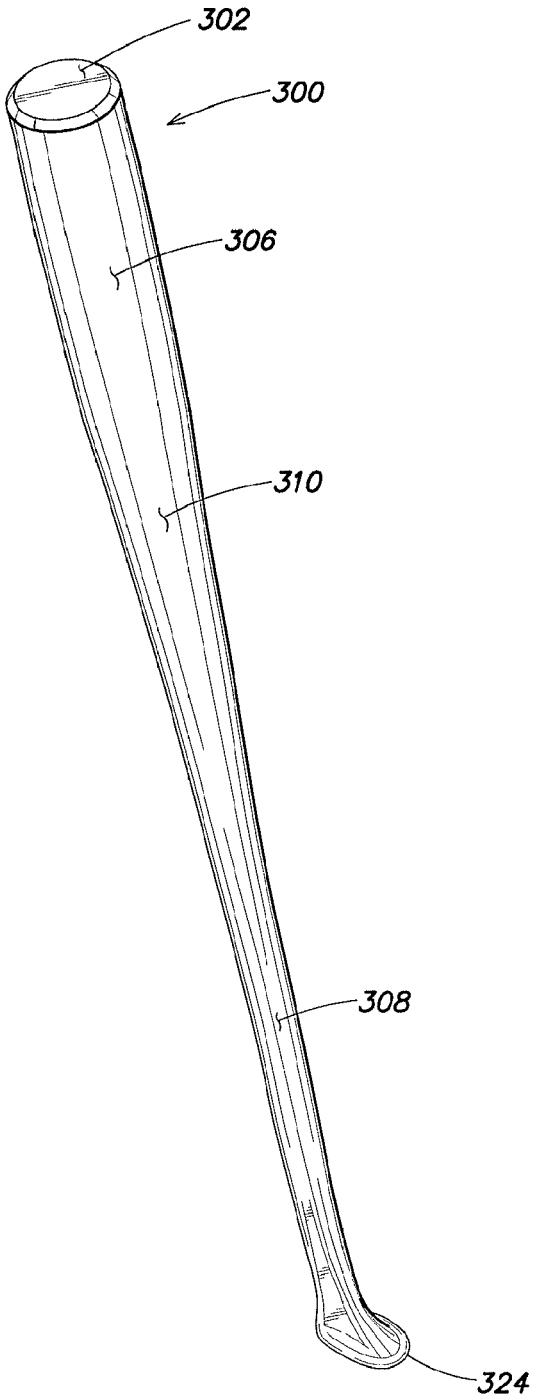
Figure 3E:
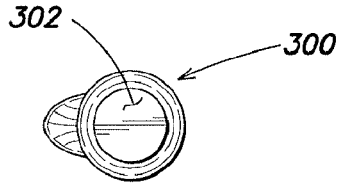
Figure 3F:
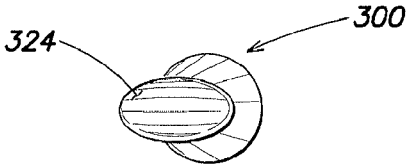
Figures 4A, 4B, 4C, 4D:
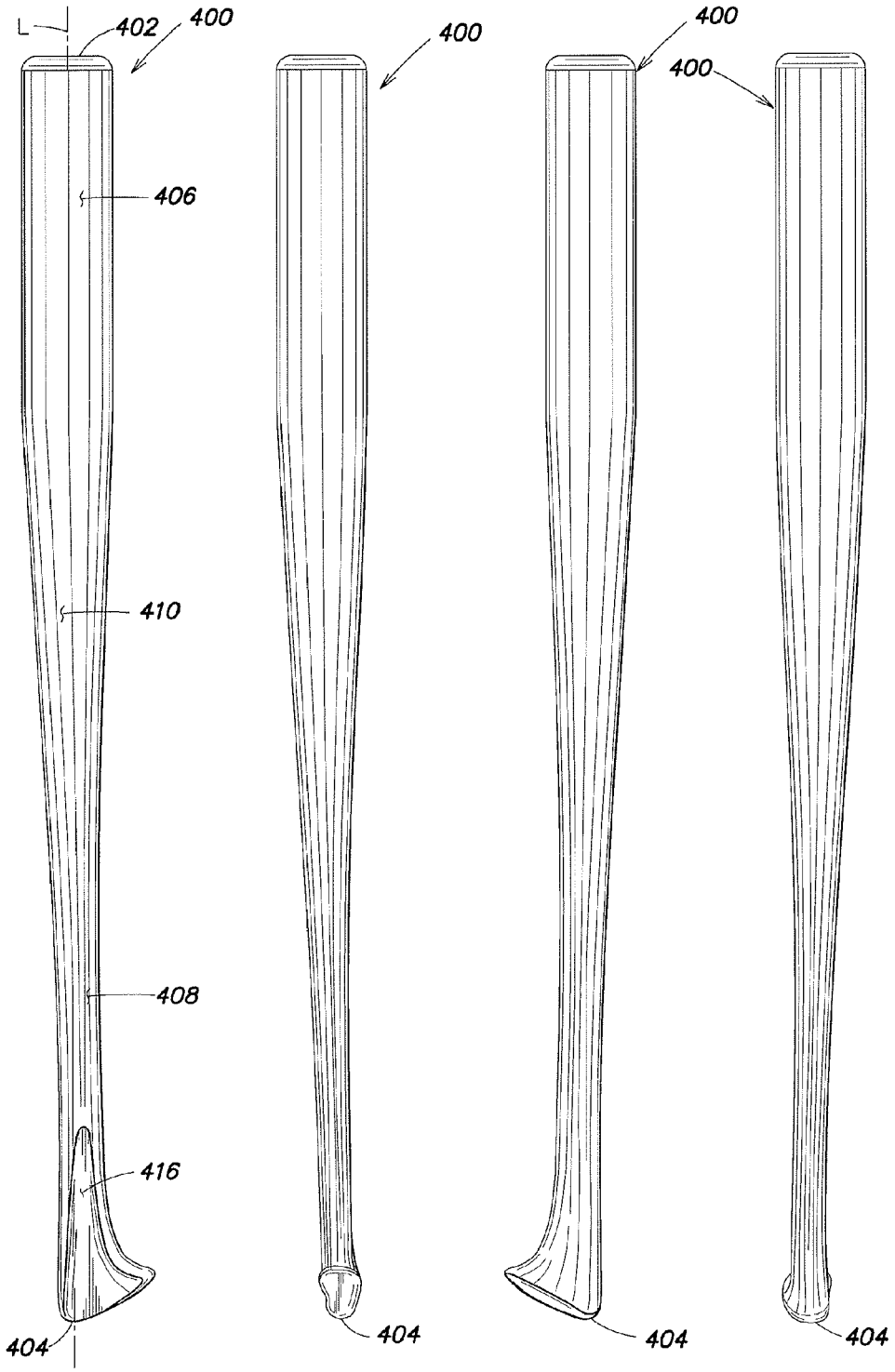
FIGS. 4A-4G show perspective views of an exemplary embodiment of a baseball bat.
Figure 4E:
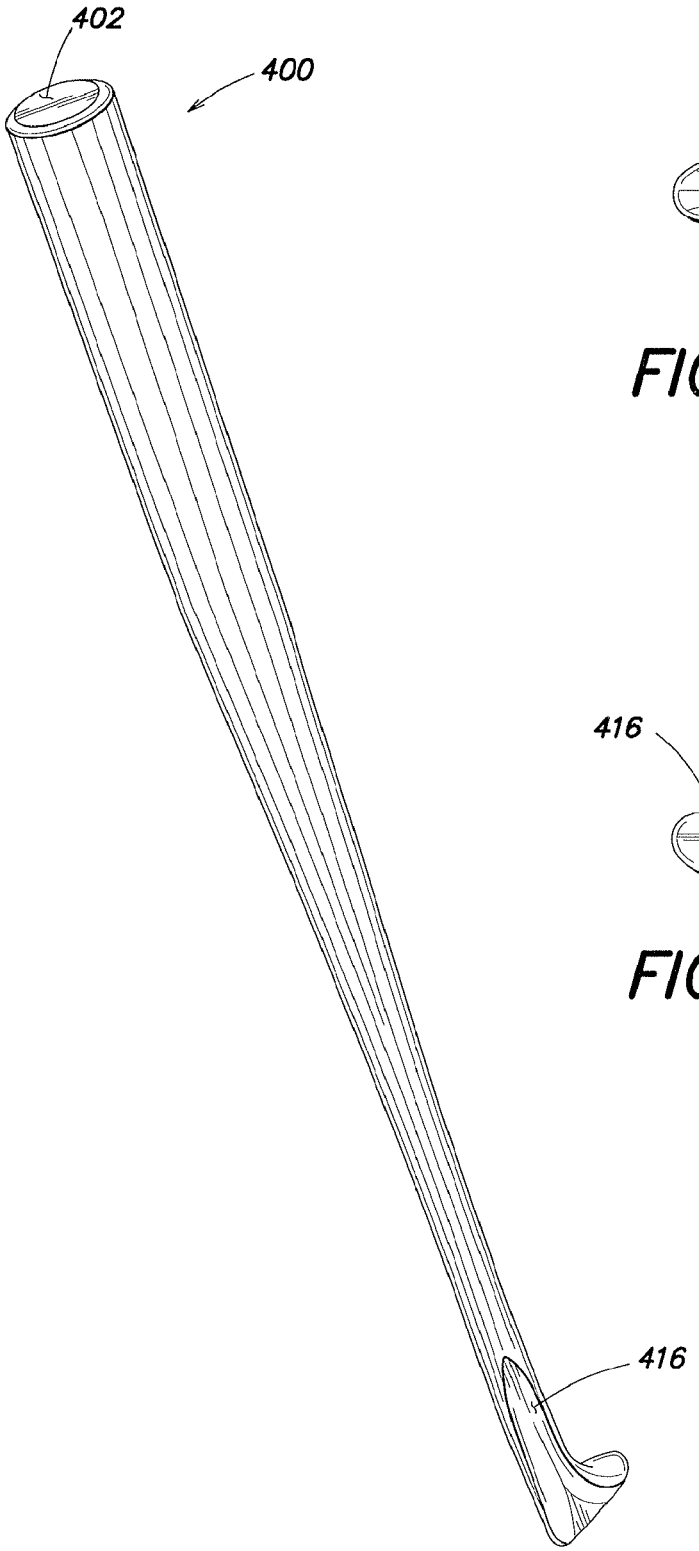
Figure 4F:
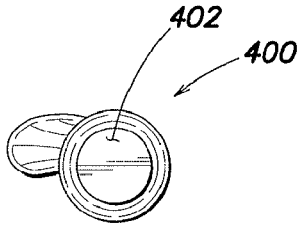
Figure 4G:
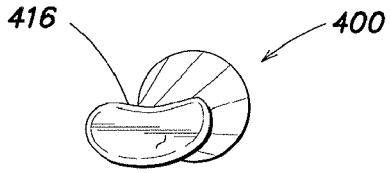

Barrels 106, 306 and 406 each have at least one cross-section that has a generally circular shape. As shown in FIGS. 1, 3A and 4A, the respective longitudinal axis, which may be designated as L herein, of each of bats 100, 300 and 400 passes through the approximate center of, and is substantially perpendicular to, at least one circular cross-section of respective barrels 106, 306 and 406. Longitudinal axes of respective embodiments described herein are used for making reference to various dimensions of the embodiments. In general, the longitudinal axis is defined by and is located centrally in the baseball bat barrel. The barrel may, but does not necessarily, include a cross-section having a generally circular perimeter with a center point that the longitudinal axis intersects. The longitudinal axis may intersect the approximate center point or centroid (i.e., the average position of the points in a figure, such as a plane figure) of a cross-section of a respective barrel.

FIGS. 2A-2J show vertical sections of exemplary baseball bat handle configurations for handles 208*a*, 208*b*, 208*c*, 208*d*, 208*e*, 208*f*, 208*g*, 208*h*, 208*i* and 208*j*, respectively, corresponding to baseball bats 200*a*, 200*b*, 200*c*, 200*d*, 200*e*, 200*f*, 200*g*, 200*h*, 200*i* and 200*j*.

A baseball bat may have at least one portion of the respective handle having a non-circular cross-sectional shape (such cross-sections being defined in planes perpendicular to longitudinal axis L), but may also have one or more handle portions that have a circular cross-section. Bat handle cross-sectional shapes may be symmetrical, with regard to an axis-of-symmetry, or they may be asymmetrical.

Figure 5A:
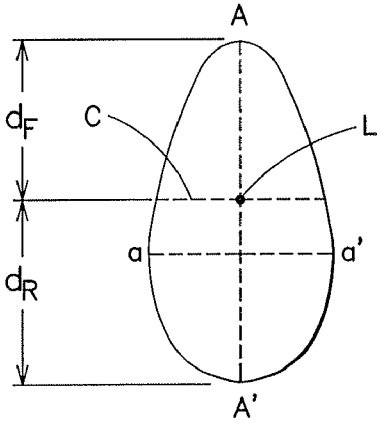
FIG. 5A shows the cross-sectional shape of the baseball bat handle of FIG. 1 at the location identified by the line $V_A$-$V_A$.
Figure 5B:
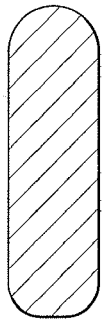
FIGS. 5B-5O show exemplary baseball bat handle cross-sectional shapes.
Figure 5C:
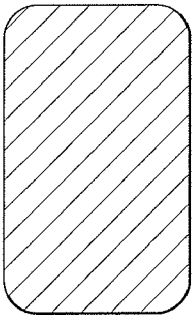
Figure 5D:
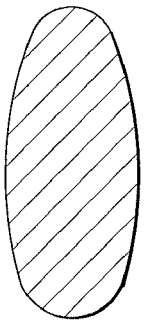
Figure 5E:
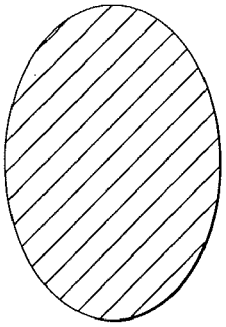
Figure 5F:
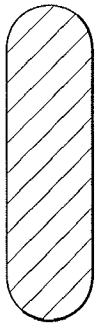
Figure 5G:
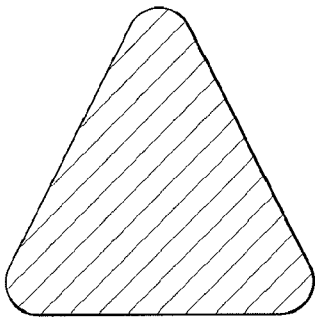
Figure 5H:
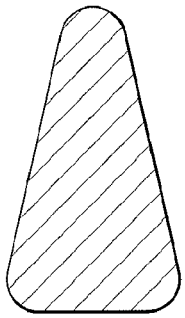
Figure 5I:
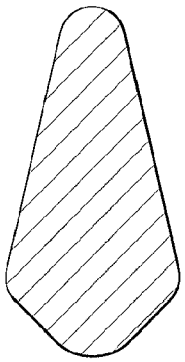
Figure 5J:
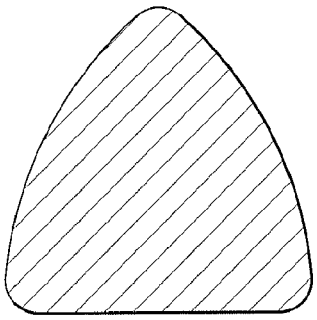
Figure 5O:
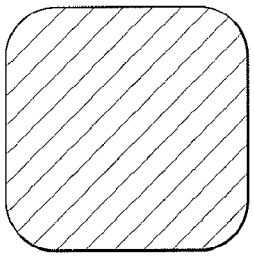

Referring to FIG. 5A there is shown an ovoid-shaped cross-section of handle 108 of FIG. 1 at the position shown at the location of the line $V_A$-$V_A$. The shape of the handle cross-section of FIG. 5A is illustrative only, as cross-sections having any perimeter shape may be used. For example, in addition to circular cross-section perimeters, handles may include any of the exemplary cross-sectional shapes shown in FIGS. 5B-5O. Additional exemplary handle cross-sectional shapes are shown in FIGS. 8A, 8B, 11B-11E and 12B. Such exemplary cross-sections may be located anywhere on baseball bat handle 108 of FIG. 1 and may have any angular orientation relative to the other portions of the baseball bat.

Figure 5K:
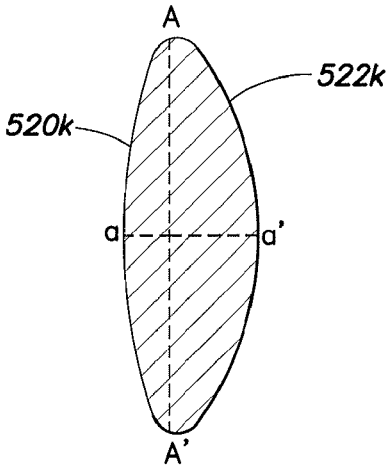
Figure 5L:
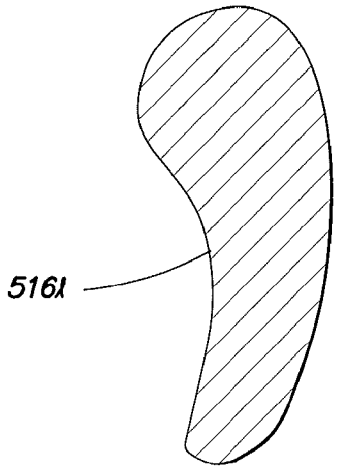
Figure 5M:
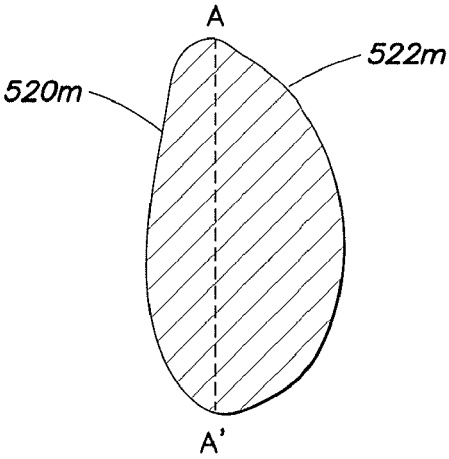

As shown in FIGS. 5A, 5K and 5M, maximally separated points, which may be designated as A and A' herein, on the perimeters of respective non-circular cross-sections define a respective major axis, A-A'. The length of a major axis is the distance between the respective endpoints A and A'. The major axis of a particular cross-section may (but does not necessarily) intersect the respective longitudinal axis, L. Major axes of different cross-sections in a single baseball bat may (but do not necessarily) reside in a common plane (i.e., a plane that would be parallel to the longitudinal axis and perpendicular to the cross-sectional planes of the baseball bat). The lengths of the major axes of a baseball bat may vary, throughout the length of the bat.

As shown, for example, in FIGS. 1, 2A-2J and 3A extremities (A and A') of a non-circular cross-section major axis may define respective front edges (e.g., 112, 212*a*, and 312) and rear edges (e.g., 114, 214*a* and 314).

As shown in FIG. 5A, a non-circular cross-section may also define a central line, which may be designated as C herein, that intersects the longitudinal axis L and is also perpendicular to the respective cross-section major axis A-A'. Front endpoints A and rear endpoints A' may be on the same side, coincident with, or on opposite sides of the respective longitudinal axis.

FIGS. 5A and 5K show that, in addition to a major axis, a non-circular cross-section can also define a respective minor axis, which may be designated as a-a' herein, wherein first endpoint a and second endpoint a' of a minor axis are the points maximally distant from each other that also exist on a line that is perpendicular to the respective cross-section major axis, A-A'. A minor axis may (but does not necessarily) intersect the respective longitudinal axis of a particular cross-section. A particular minor axis may be (but is not required to be) an axis-of-symmetry. The endpoints of a minor axis may be on the same side, or on opposite sides, of the respective longitudinal axis. Additionally, either of the minor axis endpoints may be coincident with the respective longitudinal axis. The cross-section minor axes of different cross-sections in the same baseball bat may (but do not necessarily) reside in the same plane (i.e., a plane that would be parallel to the longitudinal axis and perpendicular to the cross-sectional planes of the baseball bat). The lengths of the minor axes of a baseball bat may vary, throughout the length of the bat.

The lengths of minor axes a-a' and major axes A-A' may vary for cross-sections at different locations of a baseball bat.

Figure 5N:
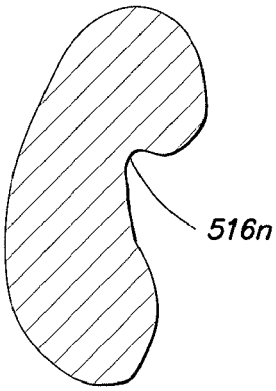

FIGS. 5A-5N show handle cross-sectional shapes that are generally oblong. Such generally oblong cross-sectional shapes include, e.g., ovals and ellipses. Generally oblong cross-sections may have one end (proximate an endpoint of a respective major axis) that is more "pointed" than the opposing end, such as the ovoid shape shown in FIG. 5A or such as the wedge shapes shown in FIGS. 5G-5J.

The major axis may be (but is not required to be) an axis-of-symmetry, such that the two "sides" of a cross-section (as defined by the perimeter portions that span from A to A') may have substantially identical shapes, as shown in FIGS. 5A-5J and 5O. Alternatively, the sides of a cross-section may have different shapes. For a particular cross-section, the distance from the respective major axis to first minor axis endpoint, a, may be (but is not required to be) equal to the distance from the respective major axis to second endpoint a' (such distances being measured along the respective minor axis). For example, as shown in FIG. 5K first side 520*k* is "flatter" than second side 522*k* (i.e., of the minor axis endpoints, a and a', the minor axis endpoint on the first side is closer to major axis A-A', where the respective distances of a and a' are measured along minor axis a-a'). Similarly, first side 520*m*, of the cross-section shown in FIG. 5M, is flatter than second side 522*m*. A single bat handle may combine various cross-sectional shapes and may, for example, possess cross-sections that are—in one portion—flatter on a first side and—in another portion—flatter on the opposing side. Such combinations of cross-sections may be employed, for example, in order to achieve particular attributes or to configure bats specifically for individual batters. Combinations of different cross-sections may also be used to configure handles advantageously for "right-handed" or "left-handed" batters.

In some exemplary embodiments, a first portion of the handle near the bottom end may have some cross-sections that are flatter on one side and a second portion of the handle (farther away from the bottom end that the first portion) may have some cross-sections that are flatter on the opposing side. In one application of such a configuration, each of the palms of a batter's hands may be able to contact relatively flatter surfaces, while also achieving other features, such as: achieving a particular handle width (i.e., the length of the minor axis of a respective cross-section) at either of the first or second portions of the handle, so as to maintain a particular degree of strength or flexibility in the handle; allowing the palms of batters' hands to be located at particular positions relative to the bat's longitudinal axis; or allowing one side of the cross-sections to have a shape preferred by a particular batter for grasping with the fingers that extend around the handle.

Figure 8B:
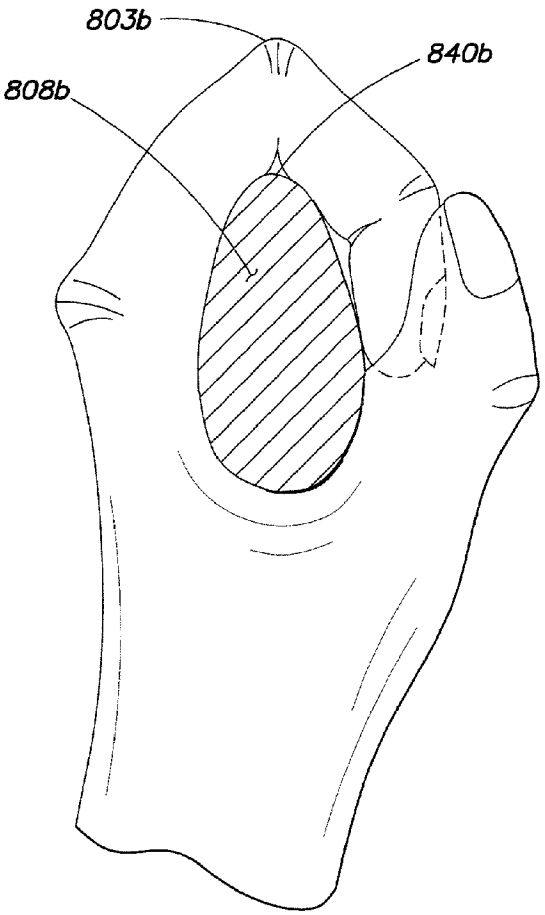
FIGS. 8A and 8B show perspective views of a batters' left hands (with the index fingers shown in partial phantom view) holding baseball bat handles, the handles being shown in cross-section.
Figure 8A:
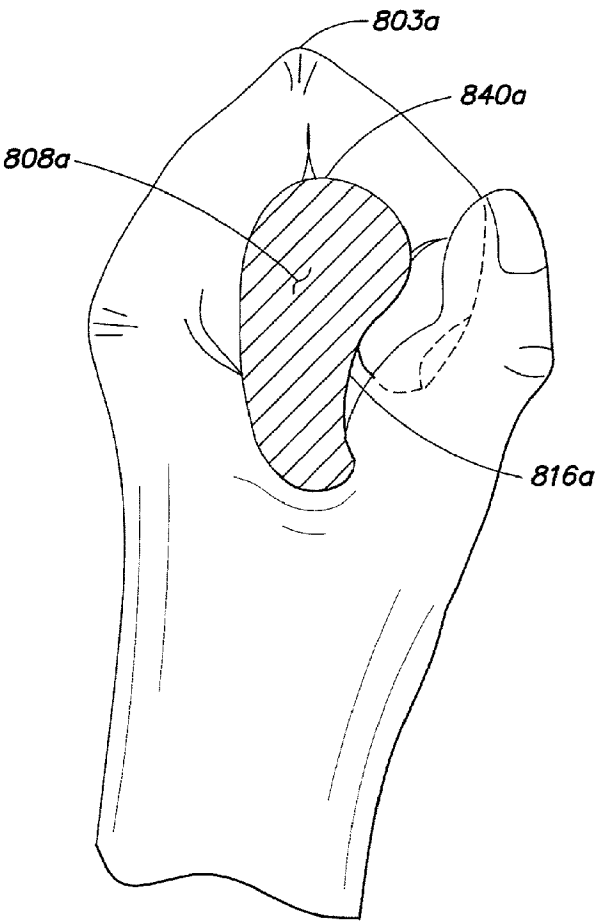

Bat handles can include regions wherein cross-sectional shapes include concave portions, such as concave surface portions 516*l* and 516*n* shown in FIGS. 5L and 5N, respectively. Such a concave contour may be involuted, such as concave surface portion 516*n* of FIG. 5N, so that the cross-section perimeter and the handle surface can define an inward curl. Such concave contours may, for example, create surface features that support parts of a batter's hand, or that provide a surface feature that may be gasped by a batter's fingers. FIG. 8A shows how the left hand (with the index finger shown in partial phantom view) of a "right-handed" batter might hold handle 808*a* (shown in cross-section) such that the batter's fingers can engage concave surface portion 816*a*.

Aside from having cross-sections that are asymmetrical, portions of bat handles may have lengthwise asymmetry. In one type of lengthwise bat handle asymmetry, shown in the embodiments of FIGS. 1, 2A-2J, 3A-3F, and 4A-4G, opposing sides or edges of the baseball bat handle have different vertical profiles. Such handles include a portion wherein the distance from the rear edge of the handle to the longitudinal axis differs from the distance from the front edge to the longitudinal axis. Accordingly, in such embodiments, a midpoint of the respective cross-section major axis (i.e., a point on the major axis that is halfway between the endpoints on the cross-section perimeter, A and A') is spaced from the point where the longitudinal axis intersects the plane of the cross-section. (The longitudinal axis may intersect the cross-section at a point on the major axis, but there is no requirement that it do so; the longitudinal axis may intersect the plane of the cross-section at any location—including points inside, outside, or on the perimeter of the cross-section.)

In a further type of lengthwise bat handle asymmetry, a portion of the handle front edge becomes increasingly farther from the central lines (C) of respective cross-sections located, at positions increasingly closer to the bottom end of the bat, but the rear edge does not diverge similarly. Such a technique—shown, for example, in FIGS. 1 and 2A-2J—can be used for positioning the baseball bat handle in a user's hands in order to allow a batter to grasp and swing a baseball bat comfortably. Such a handle configuration can permit the batter to grasp the handle more comfortably during a swing, to have a more secure grip on the bat handle, to achieve a more forceful impact when the bat hits a ball, and/or to have improved freedom of movement of the batter's hands and/or wrists. The lengthwise asymmetry of various exemplary handles shown herein allows part of the palm of the user's hand(s) (particularly the "bottom hand"—i.e., the hand that is closer the bottom end of the bat) to contact a wider and flatter handle surface than would be the case, when grasping a traditional bat handle. Traditional bat handles are generally cylindrical in shape and are about one inch in diameter. The presence of a handle portion that is generally broader and flatter than the corresponding regions of traditional bat handles, such that—in bat handles described herein—the user can position part of the palm against a broad handle portion, is a factor that permits the user to swing the bat with comfort and control. The ratios of (major axis)/(minor axis) will vary, depending on the preferences of particular batters.

In some variations, as shown for example in FIGS. 1, 2C, 2D, 2F, 2G, 2I, and 2J, the bat handle includes a portion wherein the distances from the respective longitudinal axis—or central lines (C)—to the rear edge become increasingly smaller, whereas the distances from the longitudinal axis—or central lines (C)—to the front edge becomes increasingly larger, as the front and rear edges approach the bottom end of the bat.

Figure 2A:
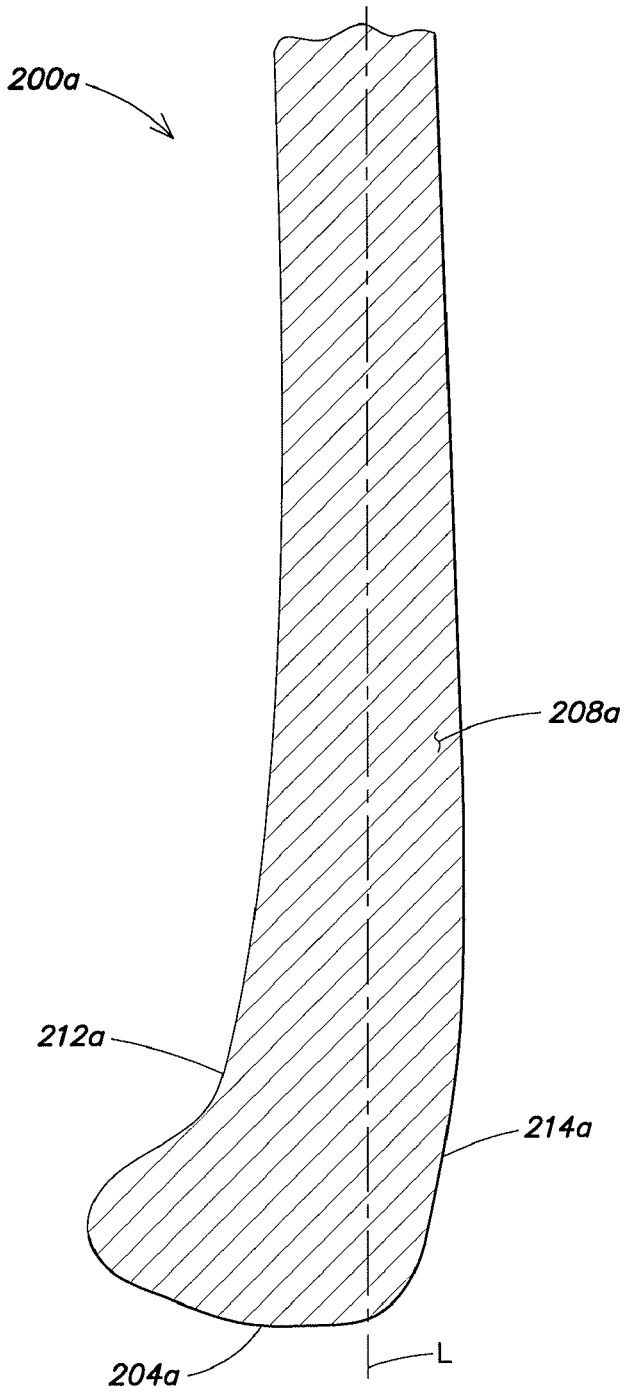
FIGS. 2A-2J show exemplary vertical sections of handle portions of baseball bats.
Figure 2B:
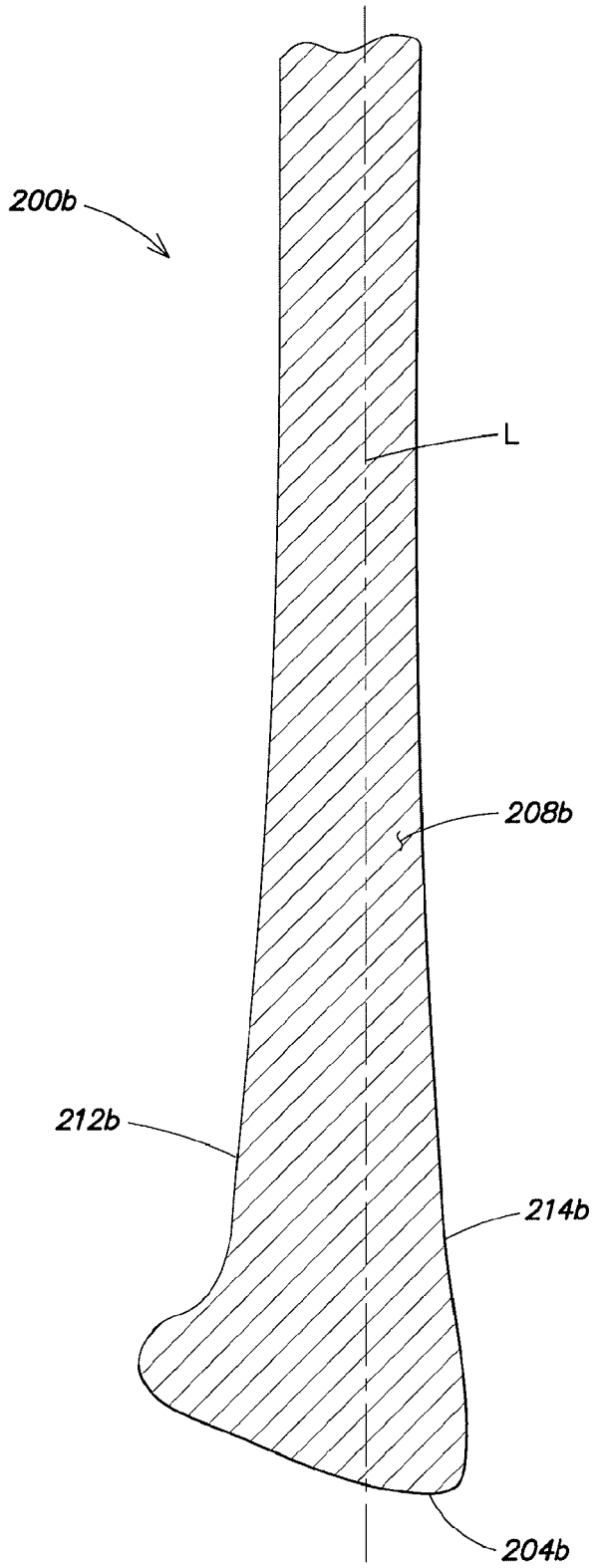
Figure 2C:
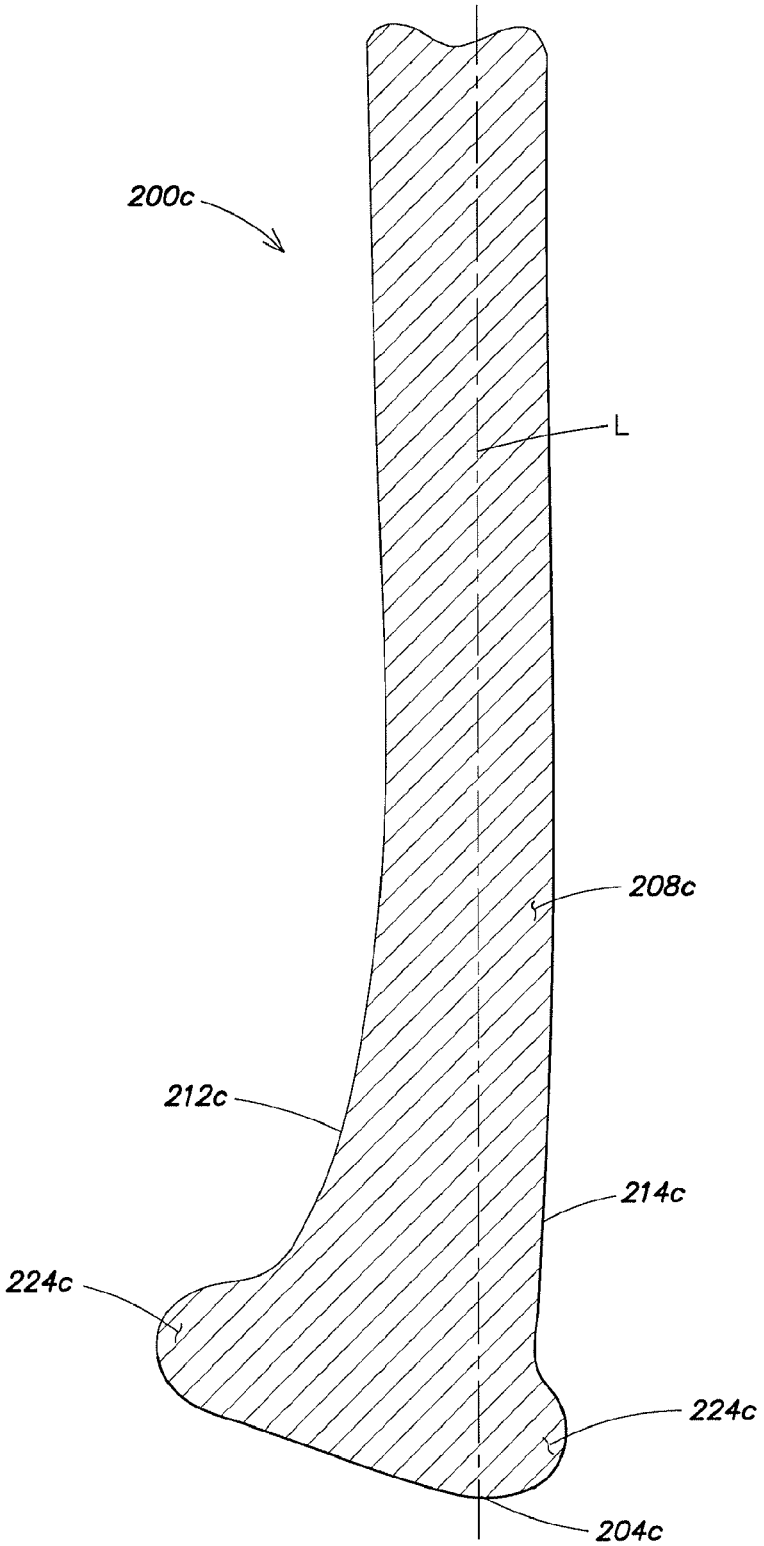
Figure 2D:
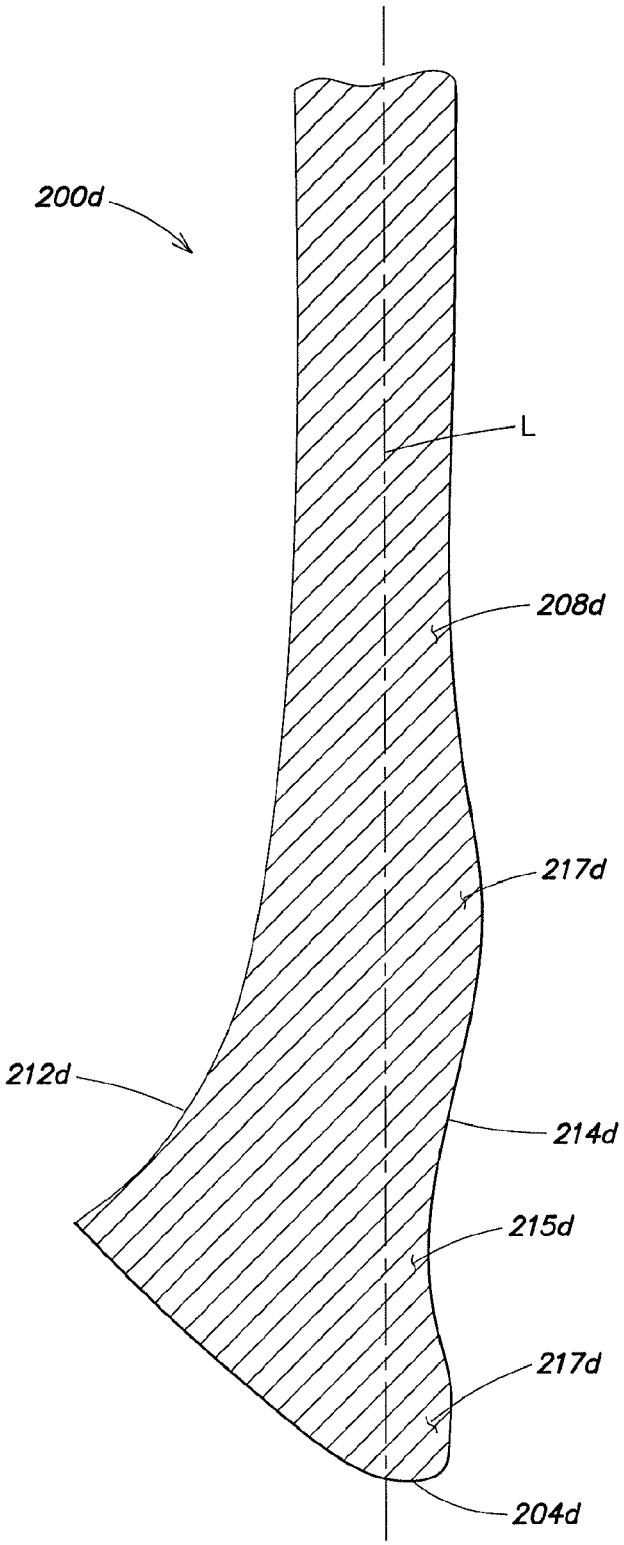
Figure 2E:
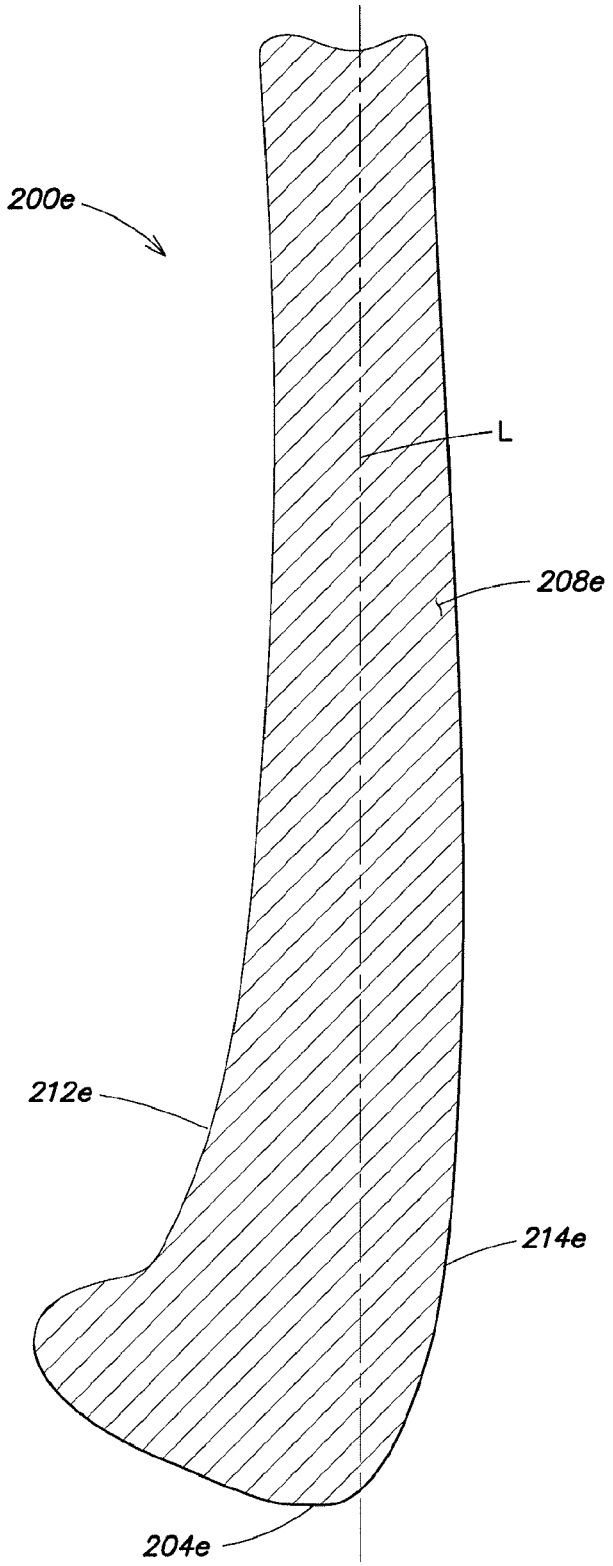
Figure 2F:
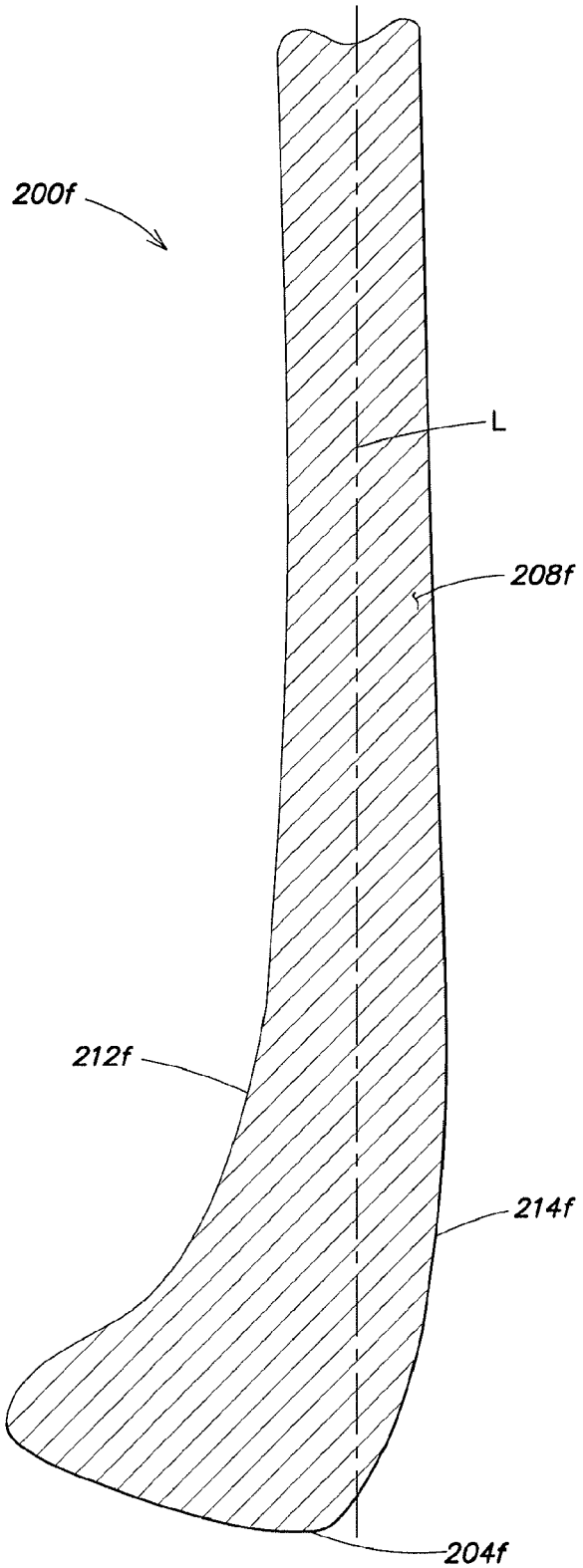
Figure 2G:
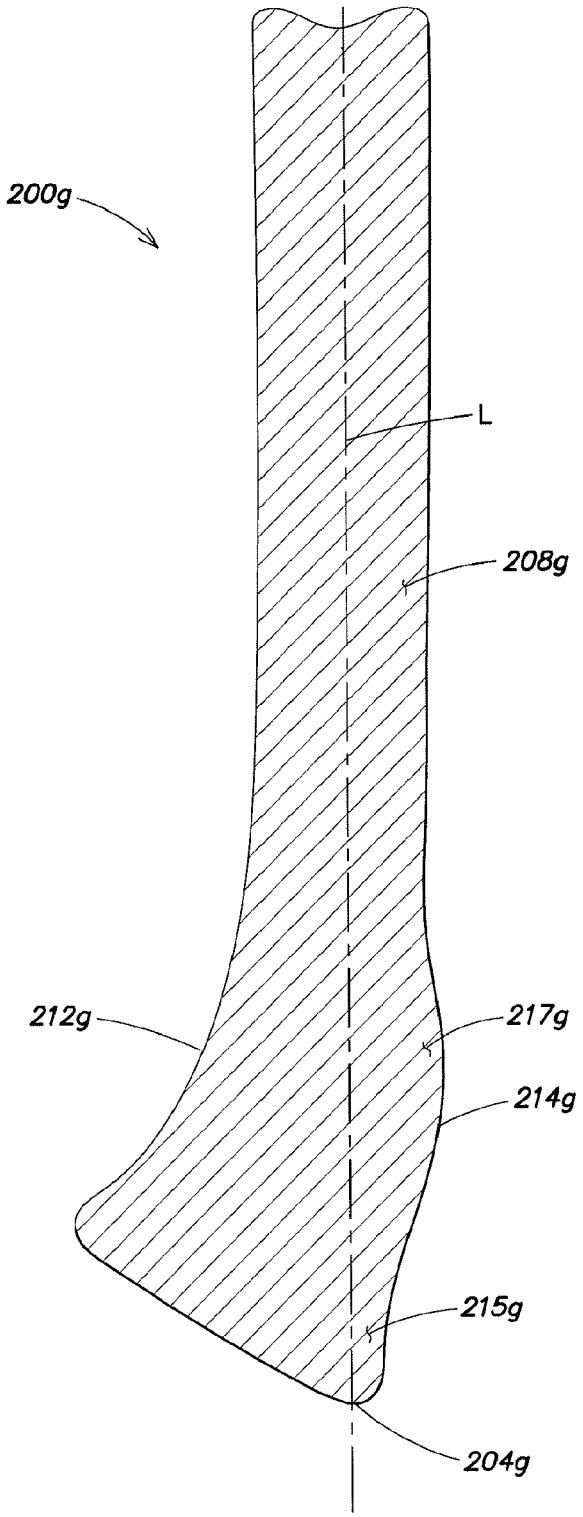
Figure 2H:
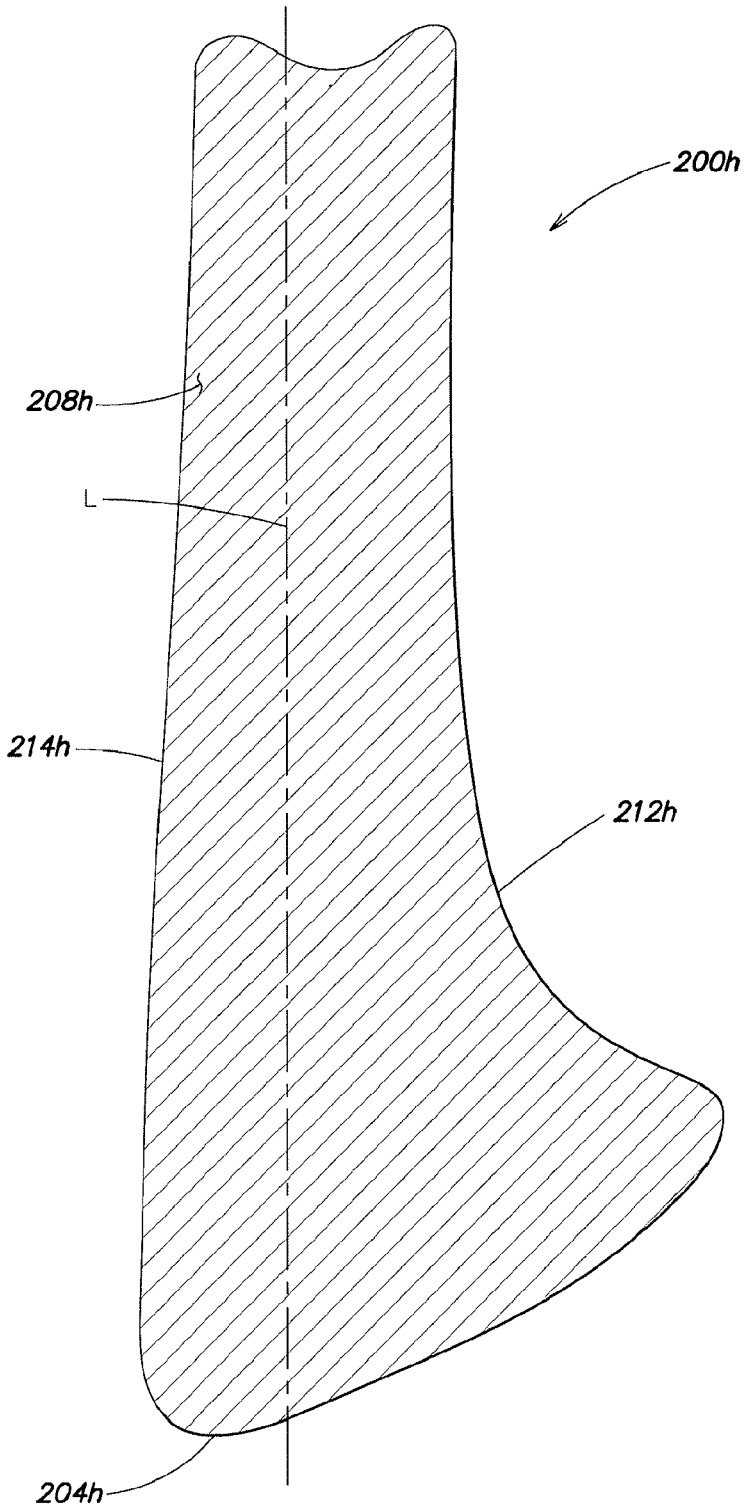
Figure 2I:
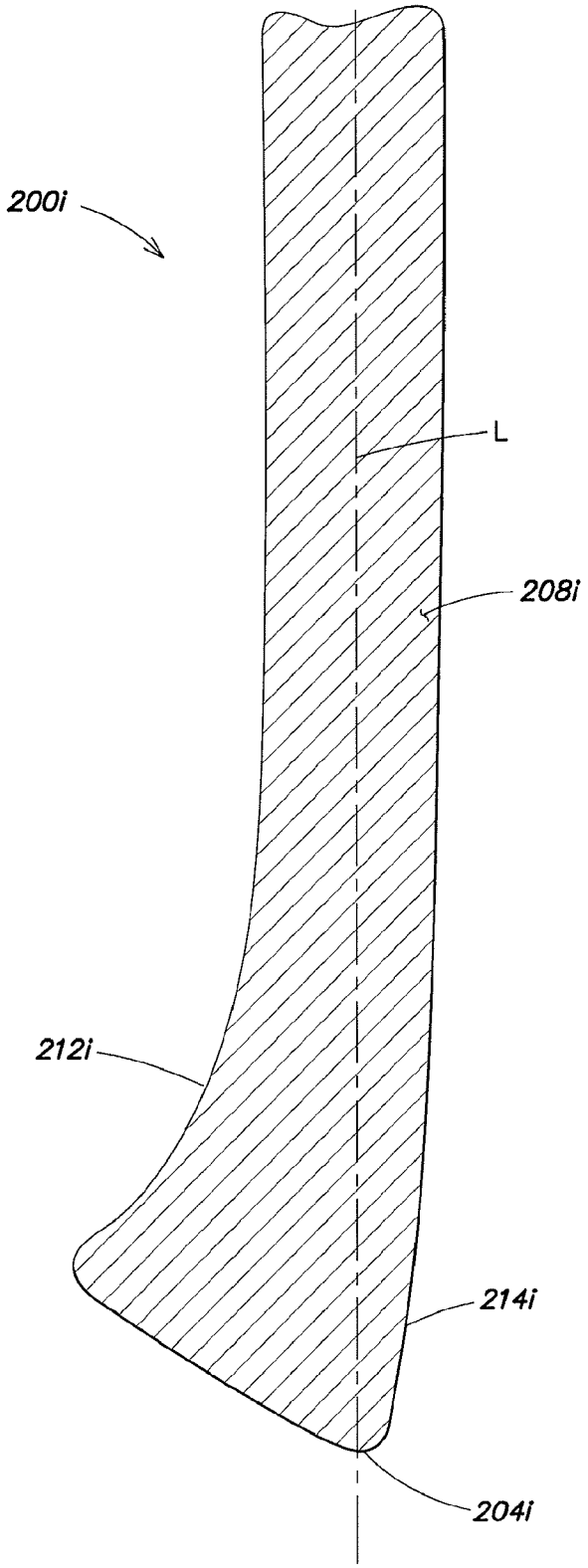

Additionally, as shown for example in FIGS. 2D and 2G, handles with lengthwise asymmetry may include portions (e.g., portions 215*d* and 215*g*) wherein the rear edge becomes closer to the longitudinal axis, as well as portions (e.g., portions 217*d* and 217*g*) wherein the rear edge becomes farther from the longitudinal axis, as the rear edge approaches the bottom end of the bat.

Other configurations of lengthwise asymmetrical handles may provide that either the front edge or the rear edge becomes continually closer to the longitudinal axis, as the respective edge approaches the bottom end of the bat. In such embodiments, one edge will be closer to the longitudinal axis, proximate the bottom end of the bat.

Figure 2J:
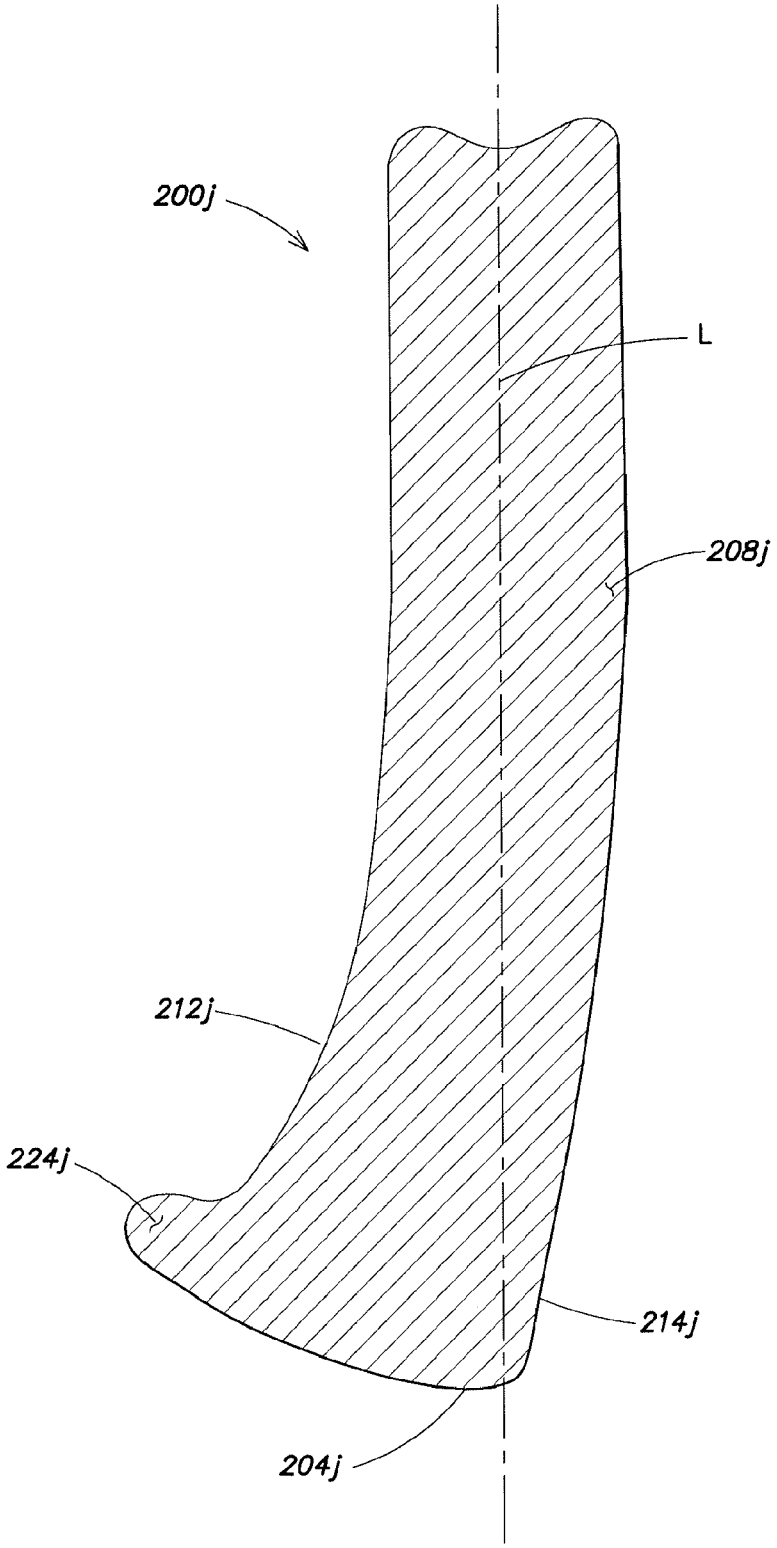
Figure 9A:
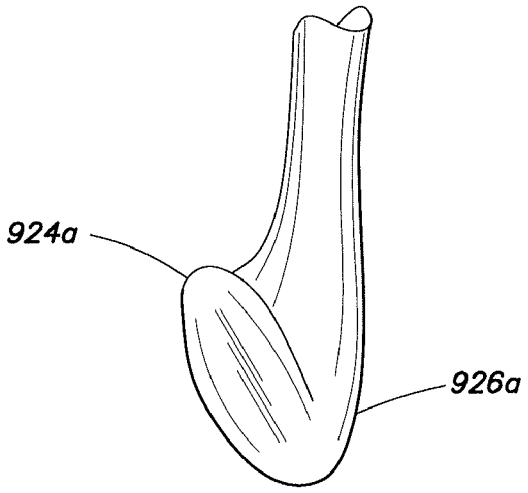
FIGS. 9A and 9B are exemplary perspective views of baseball bat handles.
Figure 9B:
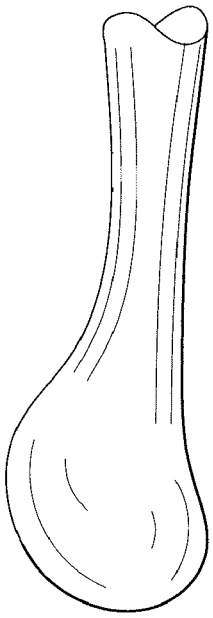

Near the bottom end, a baseball bat handle may have any desired terminating shape. It is not necessary that any part of the bat handle extend below the regions that are grasped by a batter. FIGS. 2D and 2G show handles having undersides that, when in use, may be generally flush with parts of the batter's bottom hand. Bat handles may alternatively extend below the portions of contact with a batter's hands, when grasped for swinging. For example, handles may include a "knob" proximate the bottom end. A knob can provide a surface to support part of the batter's bottom hand—particularly, the part of the hand that faces away from the top end of a bat. Baseball bats described herein may also have knobs that are skewed, such as the optionally included knob 124, shown in phantom view in FIG. 1 or knob 924*a* of FIG. 9A, so that the surfaces of the knob portion may more closely conform to the user's hand, when the bat is grasped for swinging. Such skewed knobs need not extend outwardly by a uniform distance and there may be locations, such as surface portion 926*a* of knob 924*a*, where knob 924*a* does not project outwardly at all. Additional embodiments having knobs are shown in FIG. 2J (knob 224*j*) and FIGS. 3A, 3D (knob 324). The lowermost portion of a bat may terminate in a rounded shape as shown in FIGS. 2A and 2E, for example; in one possible alternative, the handle may terminate in a bulbous configuration, as shown in FIG. 9B. Knobs or any other structures adjacent the bottom end of a bat may partly or entirely unitary with other portion(s) of the respective handle. Alternatively, they may comprise separate components—comprising the same or different materials as other portion(s) of the handle—that are joined to other portions of the handle.

Whether or not a bat handle has a structure, such as a knob, that would limit the batter's ability to grasp the bottom end of the bat, the bat may be designed such that the parts of the batter's hand near the bottom end of the bat may contact a region of the bat that has a generally oblong, or other non-circular, cross-section.

The optimal dimensions of the handle for a particular batter will depend upon such factors as the size of the batter's hands and the way the bat is grasped. The following tables provide various approximate dimensions of four exemplary embodiments of baseball bats, at locations measured along their respective longitudinal axes from their bottom ends.

The embodiment of Table 1 is a baseball bat with an asymmetrical handle, but without a knob adjacent the bottom end, similar to the exemplary handle of FIG. 1 (excluding the knob) or FIG. 2G.

TABLE 1

| Distance of Cross-Section from Bottom End of Handle | Length of Major Axis A-A' | Length of Minor Axis a-a' | Ratio of Major Axis to Minor Axis $\frac{A\text{-}A'}{a\text{-}a'}$ | Forward Distance ($d_F$) from Front Major-Axis Endpoint to Central Line (C) | Rearward Distance ($d_R$) From Rear Major-Axis Endpoint to Central Line (C) |
|---|---|---|---|---|---|
| 0.0" | 0.00" | 0.00" | — | (Bottom end of handle is 0.61" rearward of central line) | |
| 0.5" | 1" | 1.46" | 0.685 | 0.43" | 0.57" |
| 1" | 1.9" | 1.22" | 1.557 | 1.39" | 0.51" |
| 1.5" | 2" | 1.05" | 1.905 | 1.46" | 0.54" |
| 2" | 1.63" | 0.92" | 1.772 | 1.07" | 0.56" |
| 2.5" | 1.47" | 0.84" | 1.750 | 0.89" | 0.58" |
| 3" | 1.41" | 0.77" | 1.831 | 0.80" | 0.61" |
| 3.5" | 1.35" | 0.72" | 1.875 | 0.74" | 0.61" |
| 4" | 1.34" | 0.70" | 1.914 | 0.74" | 0.60" |
| 4.5" | 1.28" | 0.67" | 1.910 | 0.70" | 0.58" |
| 5" | 1.25" | 0.66" | 1.894 | 0.64" | 0.61" |
| 5.5" | 1.21" | 0.65" | 1.862 | 0.61" | 0.61" |
| 6" | 1.19" | 0.66" | 1.803 | Equal | |
| 6.5 | 1.18" | 0.67" | 1.761 | Equal | |
| 7 | 1.18" | 0.69" | 1.710 | Equal | |
| 7.5 | 1.17" | 0.70" | 1.671 | Equal | |
| 8 | 1.17" | 0.71" | 1.648 | Equal | |
| 8.5 | 1.17" | 0.72" | 1.625 | Equal | |
| 9 | 1.17" | 0.74" | 1.581 | Equal | |
| 9.5 | 1.17" | 0.76" | 1.539 | Equal | |
| 10" | 1.18" | 0.78" | 1.513 | Equal | |
| 10.5" | 1.18" | 0.78" | 1.513 | Equal | |
| 11" | 1.20" | 0.79" | 1.519 | Equal | |
| 11.5" | 1.22" | 0.81" | 1.506 | Equal | |
| 12" | 1.23" | 0.82" | 1.500 | Equal | |
| 12.5" | 1.23" | 0.84" | 1.464 | Equal | |
| 13" | 1.24" | 0.86" | 1.442 | Equal | |
| 13.5" | 1.26" | 0.89" | 1.416 | Equal | |
| 14" | 1.28" | 0.92" | 1.391 | Equal | |
| 14.5" | 1.29" | 0.96" | 1.344 | Equal | |
| 15" | 1.30" | 1.01" | 1.287 | Equal | |
| 15.5" | 1.32" | 1.05" | 1.257 | Equal | |
| 16" | 1.34" | 1.10" | 1.218 | Equal | |
| 16.5" | 1.36" | 1.15" | 1.182 | Equal | |
| 17" | 1.38" | 1.22" | 1.131 | Equal | |
| 17.5" | 1.40" | 1.25" | 1.120 | Equal | |
| 18" | 1.42" | 1.30" | 1.092 | Equal | |

Table 2 relates to an embodiment having a handle that terminates in a knob, similar to the configuration shown in FIG. 2C (having knob 224*c*).

TABLE 2

| Distance of Cross-Section from Bottom End of Handle | Length of Major Axis A-A' | Length of Minor Axis a-a' | Ratio of Major Axis to Minor Axis $\frac{A\text{-}A'}{a\text{-}a'}$ | Forward Distance ($d_F$) from Front Major-Axis Endpoint to Central Line (C) | Rearward Distance ($d_R$) From Rear Major-Axis Endpoint to Central Line (C) |
|---|---|---|---|---|---|
| 0.0" | 0.0" | 0.0" | — | (Bottom end of handle is 0.08" to the rear of central line.) | |

TABLE 2-continued

| Distance of Cross-Section from Bottom End of Handle | Length of Major Axis A-A' | Length of Minor Axis a-a' | Ratio of Major Axis to Minor Axis $\frac{A\text{-}A'}{a\text{-}a'}$ | Forward Distance ($d_F$) from Front Major-Axis Endpoint to Central Line (C) | Rearward Distance ($d_R$) From Rear Major-Axis Endpoint to Central Line (C) |
|---|---|---|---|---|---|
| 0.5" | 2.30" | 1.73" | 1.329 | 1.89" | 0.41" |
| 1" | 2.13" | 1.21" | 1.760 | 1.76" | 0.37" |
| 1.5" | 1.51" | 1.05" | 1.438 | 1.09" | 0.42" |
| 2" | 1.39" | 0.97" | 1.433 | 0.94" | 0.45" |
| 2.5" | 1.35" | 0.90" | 1.500 | 0.89" | 0.46" |
| 3" | 1.27" | 0.88" | 1.443 | 0.78" | 0.49" |
| 3.5" | 1.21" | 0.85" | 1.424 | 0.72" | 0.49" |
| 4" | 1.17" | 0.83" | 1.410 | 0.67" | 0.50" |
| 4.5" | 1.15" | 0.80" | 1.438 | 0.61" | 0.54" |
| 5" | 1.14" | 0.79" | 1.443 | 0.60" | 0.54" |
| 5.5" | 1.15" | 0.78" | 1.474 | 0.60" | 0.55" |
| 6" | 1.13" | 0.78" | 1.449 | 0.58" | 0.55" |
| 6.5 | 1.14" | 0.78" | 1.462 | 0.58" | 0.56" |
| 7 | 1.15" | 0.77" | 1.494 | 0.58" | 0.57" |
| 7.5 | 1.16" | 0.80" | 1.450 | 0.58" | 0.58" |
| 8 | 1.18" | 0.82" | 1.439 | Equal | |
| 8.5 | 1.19" | 0.84" | 1.417 | Equal | |
| 9 | 1.20" | 0.86" | 1.395 | Equal | |
| 9.5 | 1.21" | 0.86" | 1.407 | Equal | |
| 10" | 1.22" | 0.87" | 1.402 | Equal | |
| 10.5" | 1.22" | 0.88" | 1.386 | Equal | |
| 11" | 1.23" | 0.89" | 1.382 | Equal | |
| 11.5" | 1.23" | 0.90" | 1.367 | Equal | |
| 12" | 1.24" | 0.92" | 1.348 | Equal | |
| 12.5" | 1.24" | 0.93" | 1.333 | Equal | |
| 13" | 1.25" | 0.95" | 1.316 | Equal | |
| 13.5" | 1.25" | 0.97" | 1.289 | Equal | |
| 14" | 1.26" | 1.00" | 1.260 | Equal | |
| 14.5" | 1.26" | 1.03" | 1.223 | Equal | |
| 15" | 1.27" | 1.07" | 1.187 | Equal | |
| 15.5" | 1.29" | 1.08" | 1.194 | Equal | |
| 16" | 1.30" | 1.16" | 1.121 | Equal | |
| 16.5 | 1.33" | 1.22" | 1.090 | Equal | |
| 17 | 1.37" | 1.30" | 1.054 | Equal | |
| 17.5 | 1.41" | 1.37" | 1.029 | Equal | |
| 18 | 1.47" | 1.45" | 1.014 | Equal | |

Although cross sections of various portions of a bat's length (measured along the longitudinal axis) can define front and rear edges, not all cross-section major axes of a particular embodiment have to be oriented such that the major axes extend from the front edge to the rear edge of the handle. Some cross-section major axes may be oriented transversely to a line that intersects the front and rear edges. For example, in the embodiments of FIGS. 3A-3F and 4A-4G, although the cross-section major axes (for most of the length for which dimensions are provided) extend from the front edge to the rear edge, the cross-section major axes of particular regions do not. Specifically, the major axes of cross-sections located in a region including sections approximately 16.5" to 18" from the bottom end (in the embodiment of FIGS. 3A-3F) and approximately 16" to 18" from the bottom end (in the embodiment of FIGS. 4A-4G) are substantially perpendicular to lines that intersect the respective pairs of front and rear edges.

Table 3 relates to an embodiment similar to that shown in FIGS. 3A-3F.

TABLE 3

| Distance of Cross-Section from Bottom End of Handle | Distance From Front Edge to Rear Edge | Widest Portion of Cross-Section (measured along a line perpendicular to the line connecting the front and rear edges) | Ratio of Major Axis to Minor Axis $\frac{A\text{-}A'}{a\text{-}a'}$ | Distance from Front Edge to Central Line (C) | Distance From Rear Edge to Central Line (C) |
|---|---|---|---|---|---|
| 0" | 0.0" | 0.0" | — | (Bottom end of handle is 0.55" rearward of central line.) | |
| 0.5" | 2.48" | 1.29 | 1.922 | 1.71" | 0.77" |
| 1" | 1.94" | 1.01 | 1.921 | 1.23" | 0.71" |
| 1.5" | 1.52 | 0.89 | 1.708 | 0.91" | 0.61" |
| 2" | 1.37 | 0.84 | 1.631 | 0.81" | 0.56" |
| 2.5" | 1.26 | 0.80 | 1.575 | 0.72" | 0.54" |
| 3" | 1.20 | 0.78 | 1.538 | 0.67" | 0.53" |
| 3.5" | 1.12 | 0.78 | 1.436 | 0.61" | 0.51" |
| 4" | 1.12 | 0.79 | 1.418 | 0.61" | 0.51" |
| 4.5" | 1.10 | 0.80 | 1.375 | 0.59" | 0.51" |
| 5" | 1.07 | 0.82 | 1.305 | 0.56" | 0.51" |
| 5.5" | 1.06 | 0.85 | 1.247 | 0.55" | 0.51" |
| 6" | 1.06 | 0.88 | 1.205 | 0.55" | 0.51" |
| 6.5 | 1.06 | 0.89 | 1.191 | 0.55" | 0.51" |
| 7 | 1.06 | 0.90 | 1.178 | 0.54" | 0.52" |
| 7.5 | 1.07 | 0.93 | 1.151 | 0.55" | 0.52" |
| 8 | 1.07 | 0.95 | 1.126 | 0.55" | 0.52" |
| 8.5 | 1.07 | 0.98 | 1.092 | 0.54" | 0.53" |
| 9 | 1.08 | 1.00 | 1.080 | 0.54" | 0.54" |
| 9.5 | 1.10 | 1.01 | 1.089 | Equal | |
| 10" | 1.10 | 1.04 | 1.058 | Equal | |
| 10.5" | 1.11 | 1.06 | 1.047 | Equal | |
| 11" | 1.12 | 1.07 | 1.047 | Equal | |
| 11.5" | 1.12 | 1.09 | 1.028 | Equal | |
| 12" | 1.13 | 1.10 | 1.027 | Equal | |
| 12.5" | 1.14 | 1.12 | 1.018 | Equal | |
| 13" | 1.16 | 1.14 | 1.018 | Equal | |
| 13.5" | 1.16 | 1.14 | 1.018 | Equal | |
| 14" | 1.18 | 1.16 | 1.017 | Equal | |
| 14.5" | 1.20 | 1.19 | 1.008 | Equal | |
| 15" | 1.23 | 1.22 | 1.008 | Equal | |
| 15.5" | 1.26 | 1.26 | 1.000 | Equal | |
| 16" | 1.29" | 1.29 | 1.000 | Equal | |
| 16.5 | 1.31" | 1.33" | 1.015 | Equal | |
| 17 | 1.35" | 1.37" | 1.015 | Equal | |
| 17.5 | 1.41" | 1.42" | 1.007 | Equal | |
| 18 | 1.45" | 1.47" | 1.014 | Equal | |

Table 4 relates to an embodiment similar to that shown in FIGS. 4A-4G, wherein handle 408 defines concave surface portion 416.

TABLE 4

| Distance of Cross-Section from Bottom End of Handle | Distance From Front Edge to Rear Edge | Widest Portion of Cross-Section (measured along a line perpendicular to the line connecting the front and rear edges) | Ratio of Major Axis to Minor Axis $\frac{A\text{-}A'}{a\text{-}a'}$ | Distance from Front Edge to Central Line (C) | Distance from Rear Edge to Central Line (C) |
|---|---|---|---|---|---|
| 0.0" | 0.0" | 0.0" | — | (Bottom end of handle is 0.39" from Central Line.) | |
| 0.5" | 1.42" | 1.17" | 1.214 | 0.73" | 0.69" |
| 1" | 2.42" | 1.23" | 1.967 | 1.72" | 0.70" |
| 1.5" | 2.58" | 1.03" | 2.505 | 1.88" | 0.70" |
| 2" | 1.73" | 0.90" | 1.922 | 1.03" | 0.70" |
| 2.5" | 1.48" | 0.83" | 1.783 | 0.79" | 0.69" |
| 3" | 1.36" | 0.80" | 1.700 | 0.68" | 0.68" |
| 3.5" | 1.30" | 0.80" | 1.625 | 0.63" | 0.67" |

TABLE 4-continued

| Distance of Cross-Section from Bottom End of Handle | Distance From Front Edge to Rear Edge | Widest Portion of Cross-Section (measured along a line perpendicular to the line connecting the front and rear edges) | Ratio of Major Axis to Minor Axis $\frac{A\text{-}A'}{a\text{-}a'}$ | Distance from Front Edge to Central Line (C) | Distance from Rear Edge to Central Line (C) |
|---|---|---|---|---|---|
| 4" | 1.25" | 0.80" | 1.563 | 0.59" | 0.66" |
| 4.5" | 1.22" | 0.83" | 1.470 | 0.59" | 0.63" |
| 5" | 1.18" | 0.86" | 1.372 | 0.56" | 0.62" |
| 5.5" | 1.15" | 0.87" | 1.322 | 0.54" | 0.61" |
| 6" | 1.13" | 0.87" | 1.299 | 0.53" | 0.60" |
| 6.5 | 1.13" | 0.87" | 1.299 | 0.54" | 0.59" |
| 7 | 1.10" | 0.86" | 1.279 | 0.51" | 0.59" |
| 7.5 | 1.09" | 0.87" | 1.253 | 0.50" | 0.59" |
| 8 | 1.10" | 0.88" | 1.250 | 0.51" | 0.59" |
| 8.5 | 1.10" | 0.89" | 1.236 | 0.51" | 0.59" |
| 9 | 1.10" | 0.91" | 1.209 | 0.51" | 0.59" |
| 9.5 | 1.11" | 0.94" | 1.181 | 0.52" | 0.59" |
| 10" | 1.11" | 0.94" | 1.181 | 0.52" | 0.59" |
| 10.5" | 1.11" | 0.94" | 1.181 | 0.52" | 0.59" |
| 11" | 1.12" | 0.98" | 1.143 | 0.52" | 0.60" |
| 11.5" | 1.13" | 1.00" | 1.130 | 0.52" | 0.61" |
| 12" | 1.13" | 1.03" | 1.097 | 0.52" | 0.61" |
| 12.5" | 1.14" | 1.06" | 1.075 | 0.53" | 0.61" |
| 13" | 1.15" | 1.08" | 1.065 | 0.54" | 0.61" |
| 13.5" | 1.15" | 1.10" | 1.045 | 0.54" | 0.61" |
| 14" | 1.17" | 1.11" | 1.054 | 0.55" | 0.62" |
| 14.5" | 1.17" | 1.14" | 1.026 | 0.55" | 0.62" |
| 15" | 1.18" | 1.16" | 1.017 | 0.56" | 0.62" |
| 15.5" | 1.18" | 1.18" | 1.000 | 0.56" | 0.62" |
| 16" | 1.19" | 1.20" | 1.008 | 0.56" | 0.63" |
| 16.5 | 1.21" | 1.22" | 1.008 | 0.56" | 0.65" |
| 17 | 1.23" | 1.25" | 1.016 | 0.58" | 0.65" |
| 17.5 | 1.26" | 1.29" | 1.024 | 0.60" | 0.66" |
| 18 | 1.30" | 1.33" | 1.023 | 0.62" | 0.68" |

The embodiments of Tables 1, 2, and 3 have generally symmetrical cross-sectional shapes, about respective axes-of-symmetry. Thus, the distance from either endpoint of a minor axis (a or a') to the respective major axis, A-A', is generally equal to half the length of the respective minor axis, a-a'. By contrast, the embodiment of Table 4 (corresponding to FIGS. 4A-4G) includes a portion having asymmetrical cross-sections, where handle 408 defines concave surface portion 416.

Bat handles that have non-circular cross-sections—at the regions of the handle that are grasped by a batter during a swing—can facilitate a desired orientation of the bat relative to the batter's hands. For example, when grasping a handle having a generally oblong cross-sectional shape, the proximal interphalangeal joints of a batter's fingers may be positioned near: a front or rear edge of the handle; an endpoint of a cross-section major axis; an endpoint of a cross-section's axis-of-symmetry; or any location where the perimeter of a handle cross-section defines a curve with a relatively short radius of curvature (relative to radii of curvature at other locations on the respective perimeter). Such non-circular cross-sections of a portion of the bat handle constitutes a technique for orienting the baseball bat handle angularly, in the user's hands. For example, FIGS. 8A and 8B show left hands of "right-handed" batters grasping handles 808*a* and 808*b*, respectively. Handles 808*a* and 808*b* are oriented in the batters' hands such that proximal interphalangeal joints 803*a*, 803*b* of the respective batter's hands are situated near respective locations 840*a* and 840*b* that have relatively short radii of curvature.

Bat handles having non-circular cross-sectional shapes may be used with bats comprising any material(s)—e.g.

including wood (e.g., ash, maple, or hickory), metals (e.g., aluminum, steel, titanium and/or alloys of any metals), plastics, composite materials, and cured or resin-filled fibers (e.g., fiberglass, Nylon, carbon fiber, or aramid fibers such as KEVLAR fibers). Baseball bats described herein may have components made from different materials. Baseball bats described herein may be solid throughout or may be partially or entirely hollow (i.e., the type of construction commonly used for metal baseball bats). Baseball bats described herein may be assembled from separately-formed components or they may have a unitary construction.

With regard to wooden bats milled from lumber, the bat handle, when grasped by the batter, may be oriented in the batter's hands such that the wood grain may thereby become generally aligned with the direction of the bat during the batter's swing and/or during the collision of the baseball bat with a ball. Such an alignment might be achieved when the wood grains are generally parallel to the handle major axes; however, the precise orientation of the major axis relative to the wood grain will vary, depending upon the precise shape of the handle and the way a particular batter holds and/or swings the bat. The orientation of a handle cross-sectional shape relative to the disposition of wood grain can be adjusted based upon these factors, so as to achieve a particular relationship between the wood grain and the path of the bat during a batter's swing.

Figure 12A:
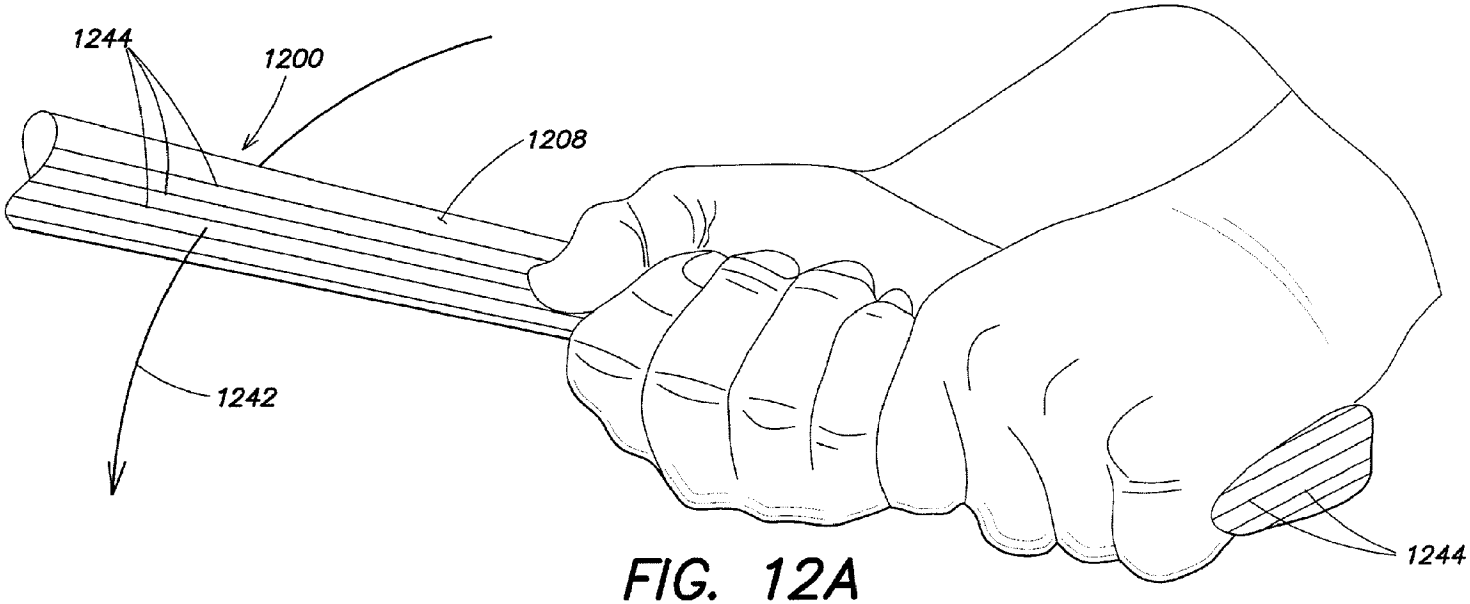
FIG. 12A is a perspective view of a batter's hands grasping an exemplary embodiment of a baseball bat handle.
Figure 12C:
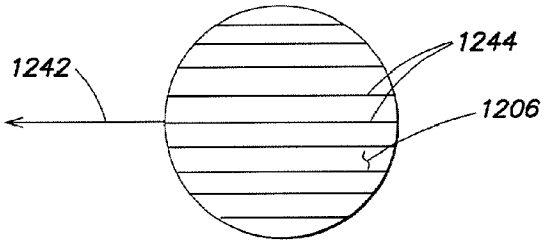
FIG. 12C is a cross-sectional perspective view of a location of the baseball bat barrel corresponding to the baseball bat of FIG. 12A.
Figure 12B:
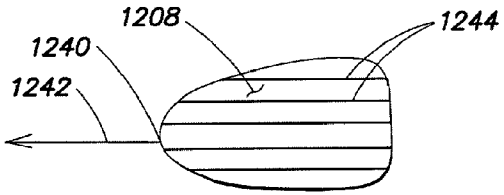
FIG. 12B is a cross-sectional perspective view of at a location of the baseball bat handle of FIG. 12A.

FIGS. 12A-12C show a batter's hands grasping handle 1208 of wooden bat 1200, such that wood grains 1244 are generally aligned to the approximate direction of the bat during a swing (shown by arrow 1242). In the disposition shown, the alignment of wood grains 1244 relative to location 1240—where handle-cross sections are relatively pointed (i.e., having a relatively short radius of curvature) shown in FIG. 12B—orients bat 1200 in the batter's hands such that wood grains 1244 at a region of barrel 1206 (shown in FIG. 2C) are also generally aligned with the direction of the swung bat, illustrated by arrow 1242. Orienting the wood grain this way, facilitates hitting a ball edgewise to the wood grain, which can help to maximize the transfer of force to the ball during impact and can decrease the likelihood that the bat will crack or otherwise become damaged or weakened from the impact.

Figure 10C:
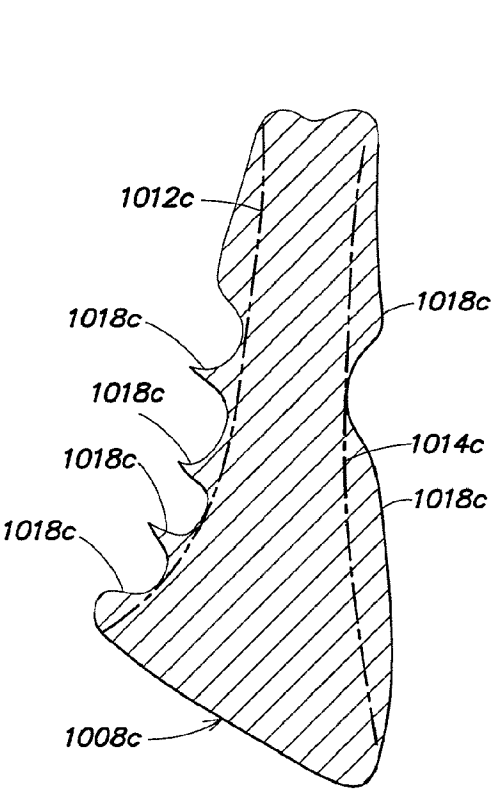
FIGS. 10A-10C are vertical sections of exemplary baseball bat handle embodiments having raised portions so as to define relatively recessed areas.
Figure 10B:
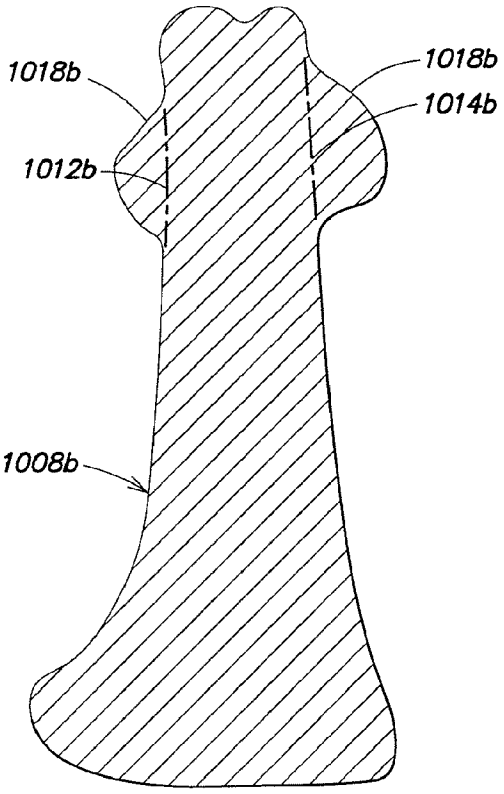
Figure 10A:
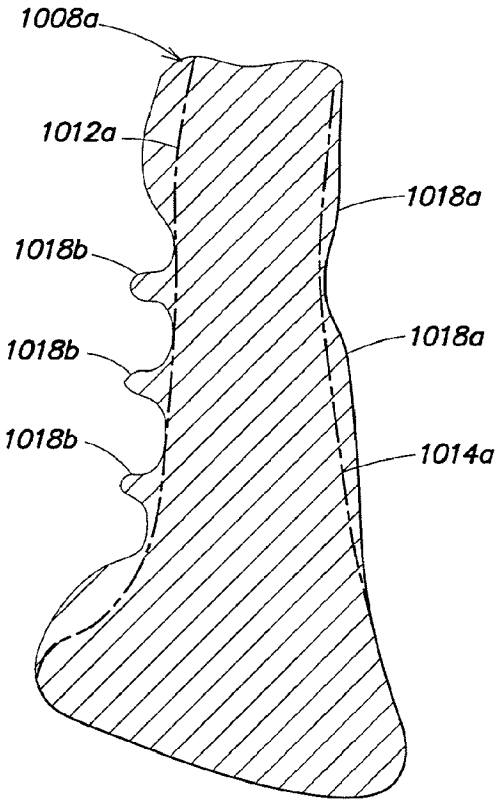

Additional techniques that may be combined with any of the handles described herein, or implemented separately, include techniques for conforming a handle to the user's hands. Such techniques may include relatively elevated regions proximate locations where a batter's fingers or palm would contact the handle, such that the fingers or other parts of the hand may fit into the relatively depressed areas of the handle. FIGS. 10A, 10B, and 10C shows vertical-sectional views of bat handles 1008*a*, 1008*b*, and 1008*c*, which have respective elevated regions 1018*c*, 1018*b*, and 1018*c* extending away from the positions (shown partially in dashed lines) that front edges (1012*a*, 1012*b*, and 1012*c*) and rear edges (1014*a*, 1014*b*, and 1014*c*) would occupy, if the elevated regions that create the relative depressions or contours were absent. Such elevated regions may be provided on any part of a baseball bat handle, and may project from front, rear, or lateral handle surfaces. As shown in FIGS. 10A, 10B, and 10C, the presence of elevated regions does not alter the effective shape of the handle—e.g., the generally oblong cross-sectional shape and the asymmetrical configuration of the handle. The effective shape of the handle is exhibited by the positions of the user's hands and/or fingers, when the bat is grasped for swinging.

Figure 11A:
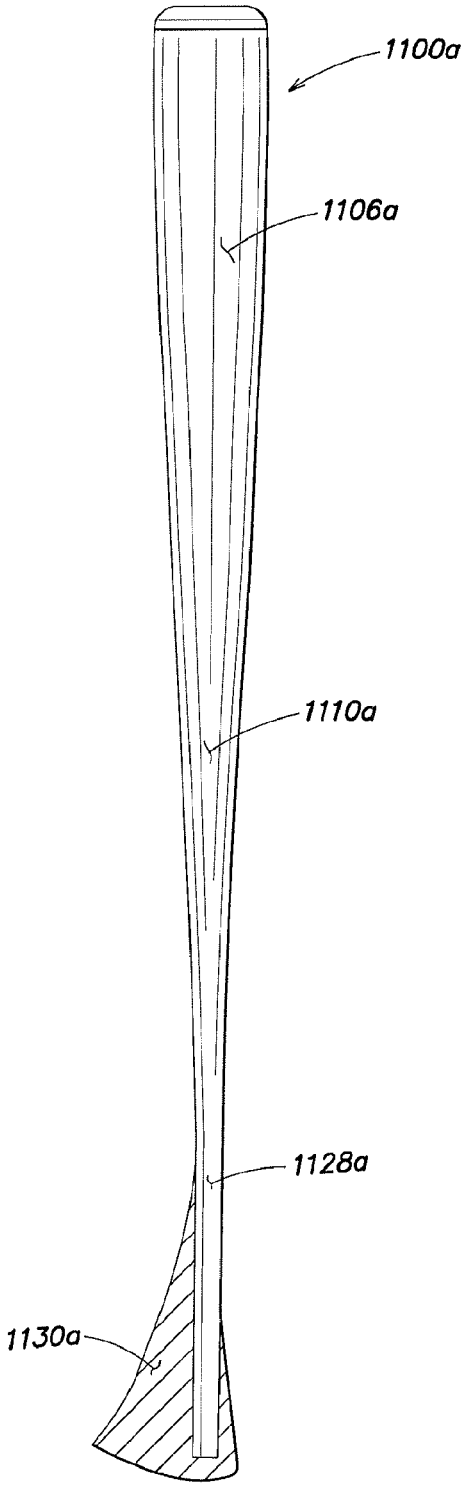
FIG. 11A is a cutaway partial sectional view of an exemplary embodiment of a baseball bat having a separately formed handle portion.

Baseball bat handles such as those of the embodiments described herein may be formed (either partly or entirely) separately from other portions of the bat. The handle, or part thereof, may for example be in the form of a sheath, cladding, wrapping, or other such item that can be attached to a completed baseball bat, regardless of the materials used (e.g., a commercially available bat made of wood or metal, for example) or a baseball bat at any stage of manufacture. For example, referring to FIGS. 11A-11E, there are shown bat first handle portions 1128*a*, 1128*b*, 1128*c*, 1128*d* and 1128*e* attached to respective separately formed portions 1130*a*, 1130*b*, 1130*c*, 1130*d* and 1130*e*. FIG. 11A shows an exemplary vertical sectional view of separately formed handle portion 1130*a* attached to first bat handle portion 1128*a* of bat 1100*a*. As FIG. 11A shows, first bat handle portion 1128*a* may, in some embodiments, be unitarily formed with throat 1110*a* and barrel 1106*a* of baseball bat 1100*a*, although there is no requirement for such first handle portions to be formed unitarily with other parts of the bat.

Figure 11B:
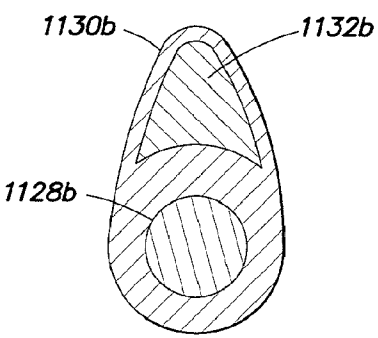
FIGS. 11B-11E are cross-sections of exemplary embodiments of baseball bat handles having one or more separately formed parts.
Figure 11C:
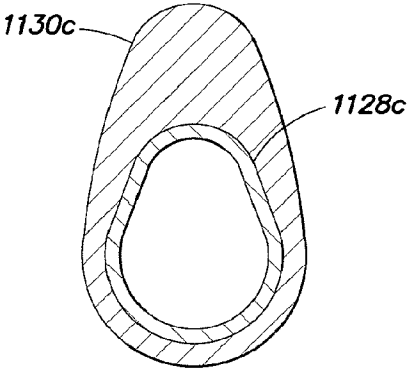
Figure 11D:
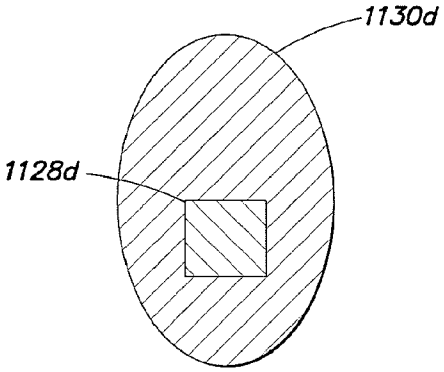
Figure 11E:
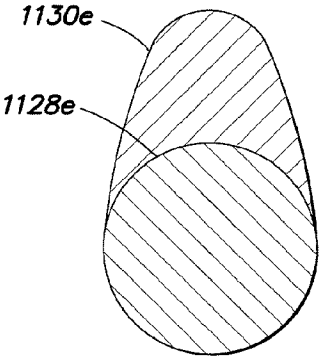

Baseball bats may include structures to facilitate the attachment of such a separately formed handle or handle portion. For example, the bat may include notches, grooves, screw threads, stipling, or other shapes or surface features where a separately formed handle portion connects to other portions of the bat. The separately formed handle portion may be attached to the bat with any appropriate technique, including but not limited to friction-fitting, bonding, adhesives, press-fitting, sonic welding, hot melting, resin curing, or the use of mechanical fasteners of any appropriate design or material (e.g., rivets, bolts, screws, nails—including forged nails, wire nails, cut nails, or nails having round or angular cross-sections—staples, or pins) and with any appropriate machinery or equipment for applying such techniques. Separately formed handle portions may be attached to other portions of the bat, in a permanent, semi-permanent, or releasable manner. Multiple separately form handle portions may be combined in a single handle, as shown in FIG. 11B, which has additional separately formed portion 1132*b*. Separately formed handle portions may be attached to other portions of the bat from any appropriate direction or orientation—i.e., from above, below, or at any location of the perimeter of a particular handle portion.

Separately formed handle portions may comprise the same material(s) as other parts of the respective bat or bat handle. Alternatively, separately formed handle portions may comprise different material(s) from those used in other parts of the respective bat or bat handle. For example, the unitarily formed barrel 1106*a*, throat 1110*a* and first handle portion 1128*a* of baseball bat 1100*a* of FIG. 11A, may comprise a first material (e.g. wood or aluminum), whereas separately formed handle portion 1130*a* may comprise a second material (e.g., plastic or fiberglass). Separately formed handle portions may be made of any suitable material—including but not limited to rubbers, plastics, elastomeric materials, foams, wood, woven or non-woven fabrics, composites, or metals.

The materials that comprise separately formed handle portions may be softer, more resilient, or may possess a greater coefficient of friction than other portions of the bat. Separately formed handle portions may be shaped or textured (e.g., with grooves or stippling), so as to permit a batter to grasp the handle more comfortable or more securely. Separately formed handle portions may be fabricated in any desired manner, including, but not limited to, molding (e.g., injection molding), computer numerical control ("CNC") machining, carving, stamping, sintering, or milling. Fashioning a handle (or handle portion) separately and/or from material different from what is used in other parts of a bat may be advantageous if, e.g., fabrication with particular materials is difficult or expensive or if bat manufacture is rendered more economical thereby. For example, insofar as the manufacture of a bat is simplified wherein the bat has symmetrical and generally circular cross-sections throughout its length (as in traditional bats)—e.g., with a lathe or other equipment for milling wooden bats—it may be advantageous to separately fabricate handle portion(s) that define non-circular cross-sections and/or asymmetrical handle configurations, if such non-circular and non-symmetrical shaped portions may be fabricated more efficiently or easily through other techniques—i.e, molding or injection-molding plastics or other materials, and stamping or otherwise forming metals.

Separately formed handle portions comprising wood may be made of unitary pieces of lumber—or wood products or wood composites in any suitable form (including plywood, fiberboard, MASONITE board and the like). For example, such separately formed handle portions may employ multiple layers of cut or milled lumber glued or laminated together. For example, such layers may employ a plurality of layers or plies of ash, maple, or hickory wood that are arranged such that the grain in one ply is arranged perpendicularly to the direction of the wood grain in an adjacent ply. Such wood layers may have any desired thickness. In one exemplary technique, layers of ash having thicknesses between about 0.1 inches and 0.2 inches may be used, but any appropriate dimensions may be employed.

The shapes and/or dimensions of separately formed handle portions may be based upon templates having selected dimensions and made of metal, wood or wood products (such as plywood, fiberboard, MASONITE board and the like), composites, plastics, or any other appropriate materials.

Any part of the handle, whether separately formed or formed unitarily with other portions of the baseball bat, may be fabricated or worked with any appropriate equipment, such as molding equipment, CNC machines (or other duplicator machines, such as machinery used in the fabrication of rifle stocks or machinery employing jigs or templates to guide a cutting tool in two-dimensional and/or three-dimensional movements), stamping equipment, or milling equipment. The number of jigs or templates to be used may be varied as necessary, according to the selected technique. For example, in the fabrication of certain illustrative embodiments, baseball bat barrels may be formed from lumber with a lathe and handles may be formed by using two, three, or four, jigs or templates representing profiles of handle perimeters or portions thereof, in order to guide a rotating or other cutting or abrasive tool and also arranged on rails or the like, to guide the tool along the length of the baseball bat.

In addition to, or aside from, baseball bat handles, non-circular cross-sections may be employed in throat and/or barrel portions of baseball bats. The throat and/or barrel of baseball bats such as those described herein may employ circular cross-sections throughout some or all of their extent. The use of non-circular cross-sections in, e.g., the throat or barrel, may be employed in order to select particular qualities such as a bat's drag (air-resistance) during the swing, resistance to twisting and/or flexing when being swung or in the process of striking a ball, and/or distribution of mass along the length of the bat.

Figure 6A:
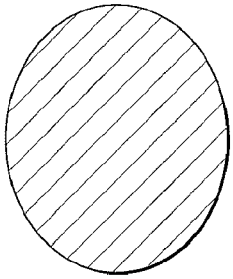
FIG. 6A shows the cross-sectional shape of the baseball bat throat of FIG. 1 at the location identified by the line $VI_A$-$VI_A$.
Figure 6B:
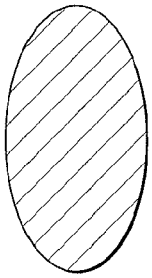
FIGS. 6B-6G show shapes of exemplary baseball bat throat cross-sectional shapes.
Figure 6C:
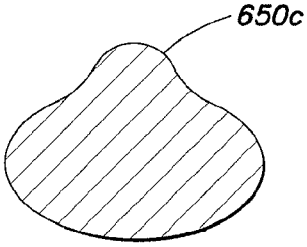
Figure 6D:
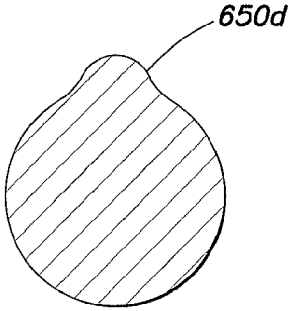
Figure 6E:
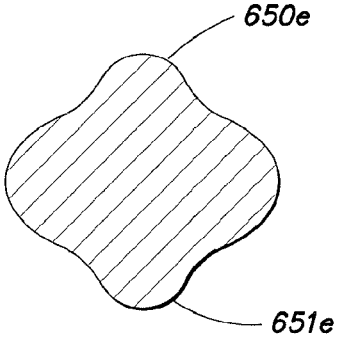
Figure 6F:
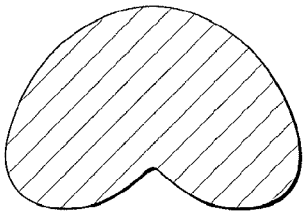
Figure 6G:
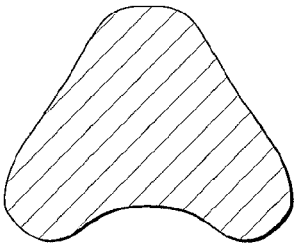

Referring to FIG. 6A there is shown an oval-shaped cross-section of throat 110 of FIG. 1 at the position shown at the location of the line $VI_A$-$VI_A$. The shape of the throat cross-section of FIG. 6A is illustrative only, as cross-sections having any shape may be used. For example, cross-sections of a throat may be circular, such as in traditional baseball bats. Throats may also have cross-sections such as those shown in FIGS. 6B-6G. Such exemplary throat cross sections may include cross-sectional shapes that define ribs (e.g., ribs 650*c*, 650*d*, 650*e*, and 651*e*), as well as cross-sectional shapes that are generally oblong (FIGS. 6A and 6B), or generally triangular (FIG. 6G) and may have any angular orientation relative to the other portions of the baseball bat.

Figure 7A:
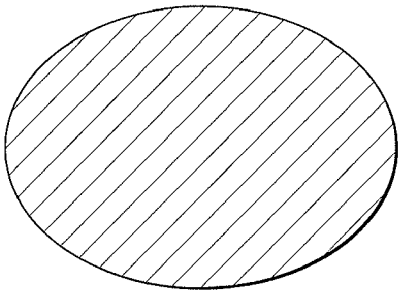
FIG. 7A shows the cross-sectional shape of the baseball bat throat of FIG. 1 at the location identified by the line $VII_A$-$VII_A$.
Figure 7B:
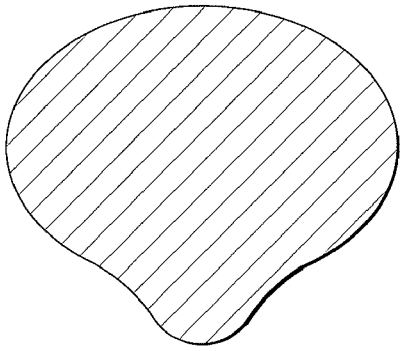
FIG. 7B shows an exemplary alternative shape of a baseball bat barrel cross-section.

Referring to FIG. 7A, there is shown an oval-shaped cross-section of barrel 106 of FIG. 1 at the position shown at the location of the line $VII_A$-$VII_A$. The shape of the barrel cross-section of FIG. 7A is illustrative only, as cross-sections having any shape may be used. For example, cross-sections of a barrel may be circular, such as is shown in FIG. 12C. Traditional baseball bats have barrels with circular cross-sections throughout the barrel—a configuration that may also be used with the embodiments shown herein. FIG. 7B shows another exemplary barrel cross-section that may be used throughout some or all of a barrel's extent. Such exemplary barrel cross-sections may have any angular orientation relative to the other portions of the baseball bat.

In any of the embodiments described herein, the top and/or bottom end of the bat may have a hollowed-out, recessed region. Such recessed ends may be used to reduce the overall weight of the bat, to achieve particular balance, center-of-mass or distribution-of-mass characteristics, or to reduce the weight at one or both of the extremities of the bat.

Any of the baseball bats described herein may employ techniques to increase their stiffness, strength, or durability. Such techniques include, but are not limited to, coating any portion of the outer surface of any portion of the bat with a coating of plastic, rubber, varnish, shellac, or paint. Such techniques may also include wrapping any portion of the bat with thread and/or cloth—such as thread, twine, or cloth made of fibrous materials, e.g., fiberglass, Nylon, carbon fiber, or aramid fibers such as KEVLAR fibers. Such thread and/or cloth may be combined with a substrate of plastic, resin, or any other matrix.

Baseball bats described herein may have cross-sectional profiles that are smooth and round. It is intended that baseball bats described herein may employ materials and dimensions in compliance with the baseball or softball equipment rules of, e.g., Major League Baseball, National Collegiate Athletic Association baseball or softball, or Little League Baseball.

Any of the techniques described herein for use in baseball bat handles, throats, or barrels may be employed, individually or in combination, in a single baseball bat. All of the techniques described herein are equally applicable to softball bats.

The foregoing descriptions and figures have been presented for purposes of example and illustration. The parameters, configurations and dimensions of baseball bats described herein are exemplary. In practice, the actual parameters, configurations and/or dimensions employed will depend on the specific application of the disclosed teachings. The descriptions and figures provided herein are not intended to limit the scope of the claims, below, to the precise forms disclosed. Many modifications and variations of the disclosed embodiments would be within the scope of the appended claims and other claims based upon the teachings herein.

It is also intended that the indefinite articles "a" and "an," as used above and in the appended claims, mean one or more of the articles which they modify, and that the terms "including," "with," "having" and the like (and variants thereof) are interchangeable with the open ended term "comprising."

What is claimed is:

1. A bat comprising:

a body, comprising a first material, the body defining an exterior surface with a top end and a bottom end;

a barrel portion having a barrel cross-section with a substantially circular perimeter that defines a center point;

the barrel cross-section defining a longitudinal axis substantially perpendicular to the barrel cross-section, the longitudinal axis intersecting the barrel cross-section at approximately the center point, the longitudinal axis intersecting and extending through the exterior surface, near the top and bottom ends, at respective upper and lower intersection points, and otherwise within the exterior surface;

a handle portion that includes the bottom end, the handle portion having a handle component comprising a second material;

the handle portion defining a maximum forward distance, measured along a first line perpendicular to the longitudinal axis, from a first point on the longitudinal axis to a first location on the exterior surface of the handle portion that is farthest forward of the longitudinal axis;

the handle portion defining a maximum rearward distance, measured along a second line perpendicular to the longitudinal axis, from a second point on the longitudinal axis to a second location on the exterior surface of the handle portion that is farthest rearward of the longitudinal axis;

the handle portion also having an asymmetrically flared region extending from an upper boundary to a lower boundary, the upper boundary being more proximate the top end and the lower boundary being more proximate the bottom end;

the asymmetrically flared region defining a non-circular cross-section perpendicular to the longitudinal axis, the non-circular cross-section having a major axis; and portions of the exterior surface, in the asymmetrically flared region, defining a front edge and a rear edge, wherein the distance from the longitudinal axis to the front edge, measured along respective lines perpendicular to the longitudinal axis, is greater than the distance from the longitudinal axis to the rear edge, for each point of the longitudinal axis throughout the asymmetrically flared region.

2. The bat of claim 1, wherein the handle component comprises plastic.

3. The bat of claim 1, wherein the major axis increases continuously throughout the asymmetrically flared region, from the upper boundary to the lower boundary.

4. The bat of claim 1, wherein the handle portion has a region with at least one cross-section that defines a substantially circular perimeter thereof.

5. The bat of claim 1, wherein the distance from the longitudinal axis to the front edge is not less than the distance from the longitudinal axis to the rear edge, for each point of the longitudinal axis that is within the asymmetrically flared region.

6. The bat of claim 1, wherein the non-circular cross-section defines a perimeter having an oblong shape.

7. The bat of claim 1, wherein the distance from the upper boundary to the lower boundary of the asymmetrically flared region occupies at least 2 inches, measured along the longitudinal axis.

8. A bat comprising:

a body defining an exterior surface with a top end and a bottom end, the body having a barrel portion that includes the top end, a throat portion, and a handle portion that includes the bottom end;

the barrel portion comprising a first material, the barrel portion having a barrel cross-section with a substantially circular perimeter that defines a center point;

the barrel cross-section defining a longitudinal axis substantially perpendicular to the barrel cross-section, the longitudinal axis intersecting the barrel cross-section at approximately the center point, the longitudinal axis intersecting and extending through the exterior surface, near the top and bottom ends, at respective upper and lower intersection points, and otherwise within the exterior surface;

the throat portion comprising a second material, the throat portion having an upper extent and a lower extent, the upper extent being more proximate the top end and the lower extent being more proximate the bottom end;

the handle portion having a handle component comprising a third material;

the handle portion defining a maximum forward distance, measured along a first line perpendicular to the longitudinal axis, from a first point on the longitudinal axis to a first location on the exterior surface of the handle portion that is farthest forward of the longitudinal axis;

the handle portion defining a maximum rearward distance, measured along a second line perpendicular to the longitudinal axis, from a second point on the longitudinal axis to a second location on the exterior surface of the handle portion that is farthest rearward of the longitudinal axis;

the handle portion having an asymmetrically flared region extending from an upper boundary to a lower boundary, the upper boundary being more proximate the top end and the lower boundary being more proximate the bottom end;

the asymmetrically flared region defining a non-circular cross-section perpendicular to the longitudinal axis, the non-circular cross-section having a major axis; and portions of the exterior surface, in the asymmetrically flared region, defining a front edge and a rear edge, wherein the distance from the longitudinal axis to the front edge, measured along respective lines perpendicular to the longitudinal axis, is greater than the distance from the longitudinal axis to the rear edge, for each point of the longitudinal axis throughout the asymmetrically flared region.

9. The bat of claim 8, wherein the handle portion further comprises a wrapping.

10. The bat of claim 8, wherein the major axis increases continuously throughout the asymmetrically flared region, from the upper boundary to the lower boundary.

11. The bat of claim 8, wherein the distance from the longitudinal axis to the front edge is not less than the distance from the longitudinal axis to the rear edge, for each point of the longitudinal axis that is within the asymmetrically flared region.

12. The bat of claim 8, wherein the non-circular cross-section defines a perimeter having an oblong shape.

13. The bat of claim 8, wherein the first material comprises a metal.

14. The bat of claim 8, wherein the second material comprises resin-filled fibers.

15. The bat of claim 8, wherein the third material comprises plastic.

16. A bat comprising:

a body, the body defining an exterior surface with a top end and a bottom end;

a barrel portion having a barrel cross-section with a substantially circular perimeter that defines a center point;

the barrel cross-section defining a longitudinal axis substantially perpendicular to the barrel cross-section, the longitudinal axis intersecting the barrel cross-section at approximately the center point, the longitudinal axis intersecting and extending through the exterior surface, near the top and bottom ends, at respective upper and lower intersection points, and otherwise within the exterior surface;

a handle portion that includes the bottom end, the handle portion having a handle component;

the handle portion defining a maximum forward distance, measured along a first line perpendicular to the longitudinal axis, from a first point on the longitudinal axis to a first location on the exterior surface of the handle portion that is farthest forward of the longitudinal axis;

the handle portion defining a maximum rearward distance, measured along a second line perpendicular to the longitudinal axis, from a second point on the longitudinal axis to a second location on the exterior surface of the handle portion that is farthest rearward of the longitudinal axis;

the handle portion having a region with at least one cross-section that defines a substantially circular perimeter thereof;

the handle portion also having an asymmetrically flared region extending from an upper boundary to a lower boundary, the upper boundary being more proximate the top end and the lower boundary being more proximate the bottom end;

the asymmetrically flared region defining a non-circular cross-section perpendicular to the longitudinal axis, the non-circular cross-section having a major axis;

portions of the exterior surface, in the asymmetrically flared region, defining a front edge and a rear edge, wherein the distance from the longitudinal axis to the front edge, measured along respective lines perpendicular to the longitudinal axis, is greater than the distance from the longitudinal axis to the rear edge, for each point of the longitudinal axis throughout the asymmetrically flared region; and at least one point of the longitudinal axis, in the asymmetrically flared region, corresponding to a non-circular cross-section having a perimeter that defines an oblong shape.

17. The bat of claim 16, wherein the major axis increases continuously throughout the asymmetrically flared region, from the upper boundary to the lower boundary.

18. The bat of claim 16, wherein the handle component comprises plastic.

19. The bat of claim 16, wherein the distance from the upper boundary to the lower boundary of the asymmetrically flared region occupies at least 2 inches, measured along the longitudinal axis.

20. The bat of claim 16, wherein the body comprises metal.

21. The bat of claim 16, wherein the handle component comprises rubber.

22. The bat of claim 16, wherein the barrel cross-section includes a first barrel cross-section and wherein the barrel portion has a second barrel cross-section substantially perpendicular to the longitudinal axis, the second barrel cross-section having a non-circular barrel perimeter.

23. A sport device comprising:

an elongated member having a longitudinal axis and a first end, a handle proximate the first end of the elongated member, the handle having an asymmetrically flared portion;

a barrel proximate a second end of the elongated member, the barrel having a cross-section with a circular perimeter;

the asymmetrically flared portion extending from an upper boundary to a lower boundary, the lower boundary being closer to the first end;

the asymmetrically flared portion having an outer surface that defines a front edge and a rear edge, the front edge curved throughout the asymmetrically flared portion from the upper boundary to the lower boundary;

the front edge projecting increasingly outward, continuously throughout the asymmetrically flared portion, from the upper boundary to the lower boundary;

the rear edge projecting increasingly outward, continuously throughout the asymmetrically flared portion, from the lower boundary to the upper boundary; and the asymmetrically flared portion having cross-sections with respective ovoid perimeters, the cross-sections being perpendicular to the longitudinal axis, each ovoid perimeter including a respective first point on the front edge and a respective second point on the rear edge, each ovoid perimeter having a first radius of curvature at the respective first point and a second radius of curvature at the respective second point, the first radius of curvature being shorter than the second radius of curvature for each ovoid perimeter.

24. The sport device of claim 23 wherein the distance from the upper boundary to the lower boundary is at least two inches.

25. The sport device of claim 23 wherein the handle comprises a plurality of separate components and at least one of the plurality of separate components comprises resin-filled fibers.

26. The sport device of claim 23 wherein the handle comprises a plurality of separate components and at least one of the plurality of separate components comprises plastic.

27. The sport device of claim 23, further comprising a throat, having a cross-section with a circular perimeter, the throat being connected to both the barrel and the handle.

28. The sport device of claim 23, wherein each ovoid cross-section intersects the longitudinal axis at a respective intersection point and, for each ovoid cross-section, the distance from the respective intersection point to the respective first point exceeds the distance from the respective intersection point to the respective second point.

* * * * *